US010642177B2

(12) United States Patent
Nakamura et al.

(10) Patent No.: US 10,642,177 B2
(45) Date of Patent: May 5, 2020

(54) PROCESS CARTRIDGE AND IMAGE-FORMING APPARATUS

(71) Applicant: CANON KABUSHIKI KAISHA, Tokyo (JP)

(72) Inventors: Nobuhiro Nakamura, Numazu (JP); Tsutomu Nishida, Mishima (JP); Atsushi Okuda, Yokohama (JP); Yuka Ishiduka, Suntou-gun (JP); Hiroyuki Watanabe, Suntou-gun (JP); Hideharu Shimozawa, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/286,762

(22) Filed: Feb. 27, 2019

(65) Prior Publication Data

US 2019/0265602 A1 Aug. 29, 2019

(30) Foreign Application Priority Data

Feb. 28, 2018 (JP) ..... 2018-035738

(51) Int. Cl.
*G03G 5/147* (2006.01)
*G03G 5/06* (2006.01)
(Continued)

(52) U.S. Cl.
CPC ..... *G03G 5/14773* (2013.01); *G03G 5/0575* (2013.01); *G03G 5/0589* (2013.01);
(Continued)

(58) Field of Classification Search
CPC ..... G03G 5/147; G03G 5/14717; G03G 5/14726; G03G 5/14734
See application file for complete search history.

(56) References Cited

U.S. PATENT DOCUMENTS 6,991,881 B2 1/2006 Yoshida et al.
6,994,941 B2 2/2006 Tanaka et al.
(Continued)

FOREIGN PATENT DOCUMENTS

JP 2013-020012 1/2013

OTHER PUBLICATIONS

U.S. Appl. No. 16/272,268, Hideharu Shimozawa, filed Feb. 11, 2019.
(Continued)

*Primary Examiner* — Peter L Vajda
(74) *Attorney, Agent, or Firm* — Venable LLP

(57) ABSTRACT

Provided is an image-forming apparatus including: an electrophotographic photosensitive member including a support, a photosensitive layer, and a protective layer in the stated order; a charging unit; an exposing unit; a developing unit; a transferring unit; and a cleaning unit configured to clean off the toner, which remains on the electrophotographic photosensitive member after the transfer of the toner image from the electrophotographic photosensitive member by the transferring unit, with a cleaning blade, wherein the electrophotographic photosensitive member includes, on a surface thereof, a fatty acid metal salt-supplying unit configured to supply a fatty acid metal salt having 16 or more and 18 or less carbon atoms, and wherein the protective layer has a triphenylamine structure, one of an acryloyloxy group and a methacryloyloxy group, and a specific structure.

16 Claims, 1 Drawing Sheet

(51) Int. Cl.
*G03G 5/07* (2006.01)
*G03G 5/05* (2006.01)

(52) U.S. Cl.
CPC ..... *G03G 5/0592* (2013.01); *G03G 5/0596* (2013.01); *G03G 5/0609* (2013.01); *G03G 5/0614* (2013.01); *G03G 5/071* (2013.01); *G03G 5/075* (2013.01); *G03G 5/076* (2013.01); *G03G 5/14708* (2013.01); *G03G 5/14769* (2013.01); *G03G 5/14786* (2013.01); *G03G 5/14791* (2013.01); *G03G 5/14795* (2013.01); *G03G 5/1473* (2013.01)

(56) References Cited

U.S. PATENT DOCUMENTS

| | | | |
|---|---|---|---|
| 7,001,699 | B2 | 2/2006 | Tanaka et al. |
| 7,645,547 | B2 | 1/2010 | Okuda et al. |
| 7,655,370 | B2 | 2/2010 | Kitamura et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 8,481,236 | B2 | 7/2013 | Tanaka et al. |
| 8,632,935 | B2 | 1/2014 | Sugiyama et al. |
| 8,669,027 | B2 | 3/2014 | Anezaki et al. |
| 8,753,789 | B2 | 6/2014 | Ogaki et al. |
| 8,765,335 | B2 | 7/2014 | Tanaka et al. |
| 8,815,479 | B2 | 8/2014 | Shida et al. |
| 8,846,281 | B2 | 9/2014 | Okuda et al. |
| 8,865,381 | B2 | 10/2014 | Tanaka et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,114,565 | B2 | 8/2015 | Kawai et al. |
| 9,170,506 | B2 | 10/2015 | Tanaka et al. |
| 9,170,507 | B2 | 10/2015 | Sugiyama et al. |
| 9,188,888 | B2 | 11/2015 | Okuda et al. |
| 9,207,550 | B2 | 12/2015 | Okuda et al. |
| 9,256,145 | B2 | 2/2016 | Fujii et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,416 | B2 | 4/2016 | Noguchi et al. |
| 9,341,964 | B2 | 5/2016 | Ogaki et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,436,106 | B2 | 9/2016 | Kuno et al. |
| 9,436,107 | B2 | 9/2016 | Murakami et al. |
| 9,459,545 | B2 | 10/2016 | Tanaka et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,563,139 | B2 | 2/2017 | Kawahara et al. |
| 9,575,422 | B2 | 2/2017 | Okuda et al. |
| 9,599,915 | B2 | 3/2017 | Anezaki et al. |
| 9,599,917 | B2 | 3/2017 | Okuda et al. |
| 9,645,515 | B2 | 5/2017 | Kuno et al. |
| 9,645,516 | B2 | 5/2017 | Kawahara et al. |
| 9,684,277 | B2 | 6/2017 | Yamamoto et al. |
| 9,726,992 | B2 | 8/2017 | Sakuma et al. |
| 9,772,596 | B2 | 9/2017 | Mitsui et al. |
| 9,791,792 | B2 | 10/2017 | Miyauchi et al. |
| 9,869,032 | B2 | 1/2018 | Kawahara et al. |
| 10,073,362 | B2 | 9/2018 | Fujii et al. |
| 2005/0208402 | A1 | 9/2005 | Tanaka et al. |
| 2006/0199092 | A1* | 9/2006 | Sugino ..... G03G 5/0614 430/66 |
| 2014/0004450 | A1 | 1/2014 | Tokimitsu et al. |
| 2014/0093281 | A1 | 4/2014 | Takahashi et al. |
| 2014/0186757 | A1 | 7/2014 | Reeves et al. |
| 2014/0186758 | A1* | 7/2014 | Bellino ..... G03G 5/14786 430/66 |
| 2014/0255835 | A1* | 9/2014 | Nukada ..... G03G 5/14791 430/56 |
| 2015/0168908 | A1* | 6/2015 | Black ..... G03G 5/0575 430/56 |
| 2015/0185630 | A1 | 7/2015 | Ito et al. |
| 2015/0185631 | A1* | 7/2015 | Black ..... G03G 5/0542 430/58.3 |
| 2015/0277246 | A1 | 10/2015 | Kaku et al. |
| 2015/0277247 | A1 | 10/2015 | Sekiya et al. |
| 2015/0316863 | A1 | 11/2015 | Tanaka et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2017/0060008 | A1 | 3/2017 | Okuda et al. |
| 2017/0184986 | A1* | 6/2017 | Black ..... G03G 5/14734 |
| 2017/0192368 | A1* | 7/2017 | Black ..... G03G 5/0525 |
| 2018/0059558 | A1 | 3/2018 | Ito et al. |
| 2018/0341190 | A1 | 11/2018 | Nishi et al. |

OTHER PUBLICATIONS

U.S. Appl. No. 16/286,762, Nobuhiro Nakamura, filed Feb. 27, 2019.

U.S. Appl. No. 16/287,102, Tsutomu Nishida, filed Feb. 27, 2019.

* cited by examiner

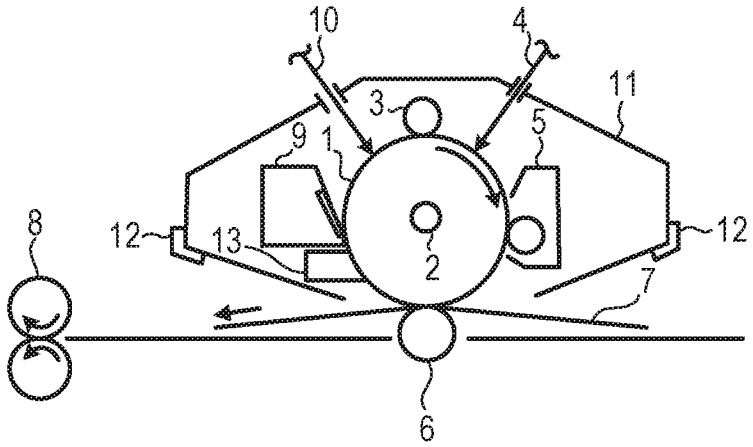
10
4
11
3
9
1
5
8
12
13
2
12
7
6

PROCESS CARTRIDGE AND IMAGE-FORMING APPARATUS

BACKGROUND OF THE INVENTION

Field of the Invention

The present invention relates to a process cartridge and an image-forming apparatus each including an electrophotographic photosensitive member.

Description of the Related Art

A wide variety of investigations have heretofore been performed on an electrophotographic photosensitive member to be mounted on an image-forming apparatus for improving its image quality and durability.

As a method of improving the abrasion resistance (mechanical durability) of the electrophotographic photosensitive member (hereinafter sometimes simply referred to as "photosensitive member"), a method involving using a radical-polymerizable resin in the surface of the photosensitive member to improve the abrasion resistance has been investigated. In addition, a method involving supplying a lubricant to the surface of the photosensitive member to improve the abrasion resistance has been investigated. Meanwhile, when the abrasion resistance is improved, it becomes difficult to clean the surface of the photosensitive member, and hence an image failure, such as a black spot or a black stripe, becomes a problem in some cases. This is considered to be caused by the following situation. It becomes difficult to remove a portion deteriorated by discharge in the surface of the photosensitive member or a toner adhering thereto with a cleaning unit, such as a blade, while shaving off the surface of the photosensitive member.

In U.S. Patent Application Publication No. 2014/186758, there is a description of an image-forming apparatus including an electrophotographic photosensitive member improved in abrasion resistance with a protective layer obtained by polymerizing a monomer having a triarylamine structure, and a monomer having a urethane group and an acrylic group. In addition, in Japanese Patent Application Laid-Open No. 2013-20012, there is a description of an image-forming apparatus in which a cleaning property is improved by supplying a lubricant to the surface of a photosensitive member to form a coating film of the lubricant, and hence image quality stability and abrasion resistance are improved.

An investigation by the present inventors has found that the image-forming apparatus described in each of U.S. Patent Application Publication No. 2014/186758 and Japanese Patent Application Laid-Open No. 2013-20012 has room for improvement in terms of the occurrence of a black spot and a black stripe during its long-term use.

SUMMARY OF THE INVENTION

Therefore, an object of the present invention is to provide an image-forming apparatus and a process cartridge in each of which the occurrence of a black spot and a black stripe during its long-term use is suppressed.

The object is achieved by the present invention described below. That is, according to one embodiment of the present invention, there is provided an image-forming apparatus including: an electrophotographic photosensitive member including a support, a photosensitive layer, and a protective layer in the stated order; a charging unit configured to charge the electrophotographic photosensitive member; an exposing unit configured to expose the electrophotographic photosensitive member to light to form an electrostatic latent image; a developing unit configured to develop the electrostatic latent image with a toner to form a toner image; a transferring unit configured to transfer the toner image from the electrophotographic photosensitive member onto a transfer material; and a cleaning unit configured to clean off the toner, which remains on the electrophotographic photosensitive member after the transfer of the toner image from the electrophotographic photosensitive member by the transferring unit, with a cleaning blade, wherein the electrophotographic photosensitive member includes, on a surface thereof, a fatty acid metal salt-supplying unit configured to supply a fatty acid metal salt having 16 or more and 18 or less carbon atoms, wherein the protective layer has a triphenylamine structure, one of an acryloyloxy group and a methacryloyloxy group, and a structure represented by one of the following general formulae (1) and (2):

(1)

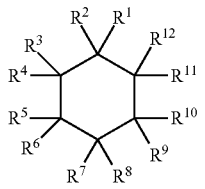

in the general formula (1), in $R^1$ to $R^{12}$, at least two of $R^1$, $R^5$, and $R^9$ each represent a structure represented by the following general formula (3), and each of the substituents except the substituents represented by the following general formula (3) in $R^1$ to $R^{12}$ is a hydrogen atom or a methyl group;

(2)

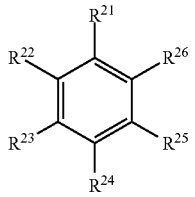

in the general formula (2), in $R^{21}$ to $R^{26}$, at least two of $R^{21}$, $R^{23}$, and $R^{25}$ each represent a structure represented by the following general formula (3), and each of the substituents except the substituents represented by the following general formula (3) in $R^{21}$ to $R^{26}$ is a hydrogen atom or a methyl group;

(3)

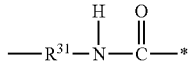

in the general formula (3), $R^{31}$ is a single bond or a methylene group that may have a substituent, $R^{31}$ bonds to the ring in the cyclic structure represented by General Formula (1) or (2), and * indicates a bonding site, wherein a content of a structure represented by one of the following general formulae (1') and (2') in the protective layer determined by pyrolysis gas chromatography-mass spectrometry is 10 mass % or more and 20 mass % or less with respect to a total weight of the protective layer:

(1')

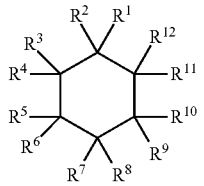

in the general formula (1'), in $R^1$ to $R^{12}$, at least two of $R^1$, $R^5$, and $R^9$ each represent a structure represented by the following general formula (3'), and each of the substituents except the substituents represented by the following general formula (3') in $R^1$ to $R^{12}$ is a hydrogen atom or a methyl group;

(2')

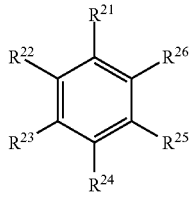

in the general formula (2'), in $R^{21}$ to $R^{26}$, at least two of $R^{21}$, $R^{23}$, and $R^{25}$ each represent a structure represented by the following general formula (3'), and each of the substituents except the substituents represented by the following general formula (3') in $R^{21}$ to $R^{36}$ is a hydrogen atom or a methyl group;

$$—R^{31}—NCO \quad (3')$$

in the general formula (3'), $R^{31}$ represents a single bond or a methylene group that may have a substituent, and wherein an A-value represented by the following formula (4) in the protective layer is 0.020 or more and 0.075 or less:

$$A=S1/S2 \quad (4)$$

in the formula (4), S1 and S2 each represent a peak area of a spectrum obtained by subjecting a surface of the protective layer to measurement by a Fourier transform infrared spectroscopy total reflection method through use of Ge as an internal reflection element and through use of a measurement condition of 45° as an incident angle, S1 represents a peak area based on in-plane deformation vibration of a terminal olefin ($CH_2$═), and S2 represents a peak area based on stretching vibration of C═O.

According to the present invention, the image-forming apparatus in which the occurrence of a black spot and a black stripe during its long-term use is suppressed can be provided.

Further features of the present invention will become apparent from the following description of exemplary embodiments with reference to the attached drawings.

BRIEF DESCRIPTION OF THE DRAWINGS

FIGURE is a schematic view for illustrating an image-forming apparatus and a process cartridge of the present invention.

DESCRIPTION OF THE EMBODIMENTS

The present invention relates to an image-forming apparatus including: an electrophotographic photosensitive member including a support, a photosensitive layer, and a protective layer in the stated order; a charging unit configured to charge the electrophotographic photosensitive member; an exposing unit configured to expose the electrophotographic photosensitive member to light to form an electrostatic latent image; a developing unit configured to develop the electrostatic latent image with a toner to form a toner image; a transferring unit configured to transfer the toner image from the electrophotographic photosensitive member onto a transfer material; and a cleaning unit configured to clean off the toner, which remains on the electrophotographic photosensitive member after the transfer of the toner image from the electrophotographic photosensitive member by the transferring unit, with a cleaning blade, wherein the electrophotographic photosensitive member includes, on a surface thereof, a fatty acid metal salt-supplying unit configured to supply a fatty acid metal salt having 16 or more and 18 or less carbon atoms, wherein the protective layer has a triphenylamine structure, one of an acryloyloxy group and a methacryloyloxy group, and a structure represented by one of the following general formulae (1) and (2):

(1)

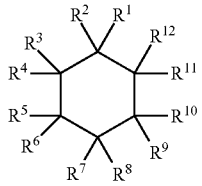

in the general formula (1), in $R^1$ to $R^{12}$, at least two of $R^1$, $R^5$, and $R^9$ each represent a structure represented by the following general formula (3), and each of the substituents except the substituents represented by the following general formula (3) in $R^1$ to $R^{12}$ is a hydrogen atom or a methyl group;

(2)

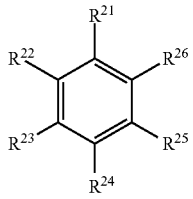

in the general formula (2), in $R^{21}$ to $R^{26}$, at least two of $R^{21}$, $R^{23}$, and $R^{25}$ each represent a structure represented by the following general formula (3), and each of the substituents except the substituents represented by the following general formula (3) in $R^{21}$ to $R^{26}$ is a hydrogen atom or a methyl group;

(3)

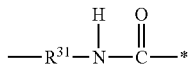

in the general formula (3), $R^{31}$ is a single bond or a methylene group that may have a substituent, $R^{31}$ bonds to the ring in the cyclic structure represented by General Formula (1) or (2), and * indicates a bonding site, wherein a content of a structure represented by one of the following general formulae (1') and (2') in the protective layer determined by pyrolysis gas chromatography-mass spectrometry is 10 mass % or more and 20 mass % or less with respect to a total weight of the protective layer:

(1')

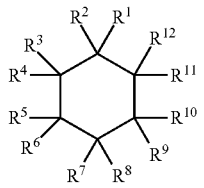

in the general formula (1'), in $R^1$ to $R^{12}$, at least two of $R^1$, $R^5$, and $R^9$ each represent a structure represented by the following general formula (3'), and each of the substituents except the substituents represented by the following general formula (3') in $R^1$ to $R^{12}$ is a hydrogen atom or a methyl group;

(2')

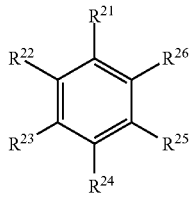

in the general formula (2'), in $R^{21}$ to $R^{26}$, at least two of $R^{21}$, $R^{23}$, and $R^{25}$ each represent a structure represented by the following general formula (3'), and each of the substituents except the substituents represented by the following general formula (3') in $R^{21}$ to $R^{26}$ is a hydrogen atom or a methyl group;

$$—R^{31}—NCO \quad (3')$$

in the general formula (3'), $R^{31}$ represents a single bond or a methylene group that may have a substituent, and wherein an A-value represented by the following formula (4) in the protective layer is 0.020 or more and 0.075 or less:

$$A=S1/S2 \quad (4)$$

in the formula (4), S1 and S2 each represent a peak area of a spectrum obtained by subjecting a surface of the protective layer to measurement by a Fourier transform infrared spectroscopy total reflection method through use of Ge as an internal reflection element and through use of a measurement condition of 45° as an incident angle, S1 represents a peak area based on in-plane deformation vibration of a terminal olefin ($CH_2$═), and S2 represents a peak area based on stretching vibration of C═O.

The present inventors have assumed the reason why the image-forming apparatus and process cartridge of the present invention are each excellent in suppression of the occurrence of a black spot and a black stripe to be as described below.

First, related art is described. At the time of the charging of a photosensitive member, a phenomenon, such as the discharge deterioration of the surface of the photosensitive member or the occurrence of a discharge product, is caused by discharge to the surface of the photosensitive member. Such phenomenon affects the removal of a toner on the surface of the photosensitive member with a cleaning blade. When the discharge deterioration of the surface of the photosensitive member occurs, a deposit, such as the toner or paper powder, is liable to strongly adhere to the activated surface. In addition, when the discharge product accumulates on the surface of the photosensitive member, friction between the cleaning blade and the surface of the photosensitive member becomes larger to destabilize the behavior of the cleaning blade, and hence it becomes difficult to remove the discharge product or the deposit. When such portion is present on the surface of the photosensitive member, the toner cannot be completely removed, and remains to appear in the form of a black spot or a black stripe on an image in some cases.

In a photosensitive member improved in abrasion resistance by arranging a protective layer using, for example, a resin of a radical polymer, it is difficult to remove a portion deteriorated by discharge or a discharge product while shaving the surface of the photosensitive member. Accordingly, an image failure, such as a black spot or a black stripe, is liable to occur. To cope with the image failure, a toner has been removed by adjusting the abrasion amount of the surface of the photosensitive member and a cleaning blade. However, the very occurrence of the discharge deterioration or the discharge product is difficult to suppress, and hence the problems of a black spot and a black stripe have not been sufficiently solved.

In addition, there has been known a method involving applying a lubricant to the surface of a photosensitive member to form a coating film of the lubricant on the surface of the photosensitive member, thereby improving the cleaning property of the photosensitive member, and by extension, improving the image quality stability thereof. In addition, the lubricant has a function of reducing the adhesive force of a toner or a discharge product through the formation of its coating film, and a function of protecting the surface of the photosensitive member from discharge deterioration through the formation in addition to the function of improving the cleaning property with its lubricity. However, in an electrophotographic process, the lubricant is gradually lost from the surface of the photosensitive member, and the deterioration of the lubricant occurs instead of the discharge deterioration of the surface of the photosensitive member, and hence its functions reduce. Accordingly, when the photosensitive member is used over a long time period, the functions cannot be sufficiently exhibited in some cases; for example, a site where the lubricant supplied to the surface of the photosensitive member is not sufficient occurs. Particularly under low temperature and low humidity, discharge becomes instable, and hence strong discharge locally occurs. Accordingly, the discharge product or the discharge deterioration is liable to strongly occur in a partial manner. As described above, the problems of a black spot and a black stripe when the photosensitive member is used over a long time period particularly under low temperature and low humidity have not been able to be sufficiently solved so far.

In order to cause the lubricant to normally function from an initial stage during the long-term use to suppress a black spot and a black stripe, the following situations are considered to be important: a sufficient amount of the coating film of the lubricant is always formed; and the deteriorated lubricant is immediately replaced with a fresh lubricant. The present inventors have made an investigation while paying attention to the viewpoint, and as a result, have found that the control of an affinity between the surface of the photosensitive member and the lubricant is important. That is, when the affinity is insufficient, a portion deficient in the lubricant occurs on the surface of the photosensitive member, and when the affinity is excessively high, the replacement between the deteriorated lubricant and the fresh lubricant is not efficiently performed. It has been generally known that polar moieties, or non-polar moieties, have a good affinity for each other. In the present invention, it is assumed that the surface of the photosensitive member and the lubricant are caused to have both of the polar moieties and the non-polar moieties to show a moderate affinity for each other, and hence a black spot and a black stripe can be suppressed from the initial stage during the long-term use.

In the present invention, the fatty acid metal salt having 16 or more and 18 or less carbon atoms is used as the lubricant that is caused to form the coating film on the surface of the photosensitive member. The fatty acid metal salt has a non-polar moiety formed of a fatty chain and a polar moiety to be bonded to a metal. Meanwhile, the electrophotographic photosensitive member according to the present invention has, in the protective layer serving as the surface of the photosensitive member, a non-polar moiety that is a structure represented by the general formula (1) or (2), and a polar moiety that is a structure represented by the general formula (3). Thus, the surface of the photosensitive member has both of the non-polar moiety formed mainly of a carbon skeleton and the moiety having relatively strong polarity.

In addition, the content of the structure represented by the general formula (1') or (2') in the protective layer determined by the pyrolysis gas chromatography-mass spectrometry (hereinafter referred to as "pyrolysis GCMS") needs to be 10 mass % or more and 20 mass % or less with respect to the total weight of the protective layer. When the content falls within the range, the amount of the structure represented by the general formula (3) present in the protective layer becomes moderate. When the content deviates from the range, the surface of the photosensitive member, and the fatty acid metal salt having 16 or more and 18 or less carbon atoms do not have a moderate affinity for each other.

Further, it has been found that when the content of the structure represented by the general formula (1') or (2') falls within the above-mentioned range, the ratio A-value(=S1/S2) of the peak area S1 based on the in-plane deformation vibration of a terminal olefin ($CH_2$=) to the peak area S2 based on the stretching vibration of C=O, the peak areas being obtained by subjecting the surface of the protective layer to measurement through the use of the infrared spectroscopy total reflection method, needs to be controlled within the range of from 0.020 to 0.075.

The ratio A-value(=S1/S2) is described. An acryloyloxy group or a methacryloyloxy group is incorporated into the protective layer of the electrophotographic photosensitive member according to the present invention. The ($CH_2$=) is derived from a residue before the polymerization of an acryloyloxy group or a methacryloyloxy group, and reflects the degree of the polymerization. In addition, the (C=O) is derived from an acryloyloxy group or a methacryloyloxy group, and the polar moiety that is a structure represented by the general formula (3). Accordingly, the ratio A-value(=S1/S2) serves as a numerical value representing the number of unpolymerized acryloyloxy groups or methacryloyloxy groups in the surface of the protective layer containing a polymer. In the present invention, it is assumed that when the A-value is 0.020 or more and 0.075 or less, a urethane bond moiety is moderately present on the surface of the protective layer to show a moderate affinity for the fatty acid metal salt having 16 or more and 18 or less carbon atoms, and hence the occurrence of a black spot and a black stripe can be suppressed. The A-value is more preferably 0.050 or more and 0.065 or less. When the A-value is less than 0.020, a urethane bond moiety hardly appears on the surface side of the polymerized protective layer, and hence a portion where the affinity becomes insufficient is formed. It is assumed that when the A-value is more than 0.075, a urethane bond moiety easily appears on the surface, but the deteriorated lubricant is hardly scraped off, and hence the suppression of a black spot and a black stripe becomes insufficient.

Next, the structures represented by the general formula (1) and the general formula (2) are described.

Specific examples of the general formula (1) are shown in the structural formulae (1-1) to (1-3).

(1-1)

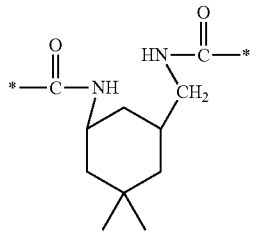

(1-2)

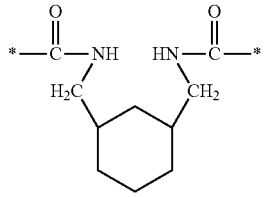

(1-3)

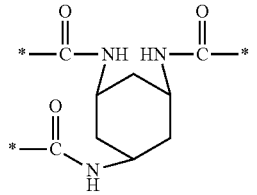

Specific examples of the general formula (2) are shown in the structural formulae (2-1) to (2-5).

(2-1)

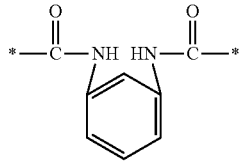

(2-2)

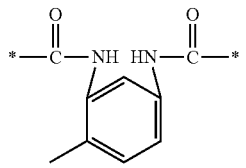

-continued (2-3)

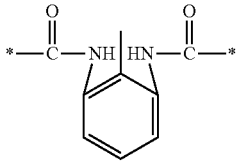

(2-4)

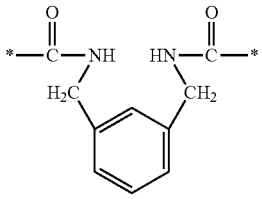

(2-5)

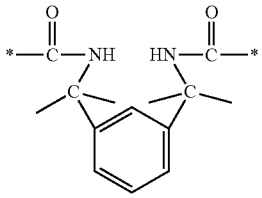

A structure represented by the general formula (1) having an alicyclic group is preferred to a structure represented by the general formula (2) having an aromatic ring because the former structure is less susceptible to discharge than the latter structure is.

A urethane acrylate may be used as a compound having an acryloyloxy group or a methacryloyloxy group and a structure represented by the general formula (1) or (2). A commercial material may be used as the urethane acrylate that may be used in the present invention, or a compound synthesized by a known method may be used. The method is, for example, a method involving causing a compound having an isocyanate group, and a compound having an acryloyloxy group or a methacryloyloxy group and a hydroxyl group to react with each other. The method is performed under, for example, the following reaction conditions: under the condition of from 50° C. to 80° C., an existing organotin catalyst (e.g., dibutyltin dilaurate) is used as a catalyst, and methyl ethyl ketone or ethyl acetate is used as a solvent.

Similarly, commercial materials may be used as the compound having an isocyanate group, and the compound having an acryloyloxy group or a methacryloyloxy group and a hydroxyl group, or compounds synthesized by known methods may be used.

For example, a synthesis example of a urethane acrylate represented by the following structural formula (L-1) is described. The urethane acrylate may be obtained by adding 1 mol of isophorone diisocyanate represented by the structural formula (A-1) (manufactured by Tokyo Chemical Industry Co., Ltd.) and 2 mol of 2-hydroxyethyl acrylate represented by the structural formula (A-2) (product name: LIGHT ESTER HOA, manufactured by Kyoeisha Chemical Co., Ltd.) to each other under the conditions of 80° C. and 30% RH. Dibutyltin dilaurate may be used as a catalyst, and methyl ethyl ketone may be used as a solvent.

(A-1)

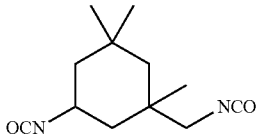

(A-2)

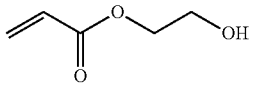

(L-1)

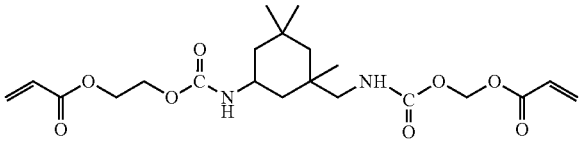

In a structure represented by the general formula (3), * represents a moiety having a bond, and the moiety may be bonded to such an arbitrary structure that the surface of the photosensitive member and the fatty acid metal salt have a moderate affinity for each other. In the present invention, the structure represented by the general formula (3) is preferably a urethane structure, and the moiety having a bond represented by * is preferably a moiety to be bonded to the structure represented by the general formula (3) through an oxygen atom.

Specific examples of the urethane acrylate are shown in the structural formulae (L-2) to (L-7).

(L-2)

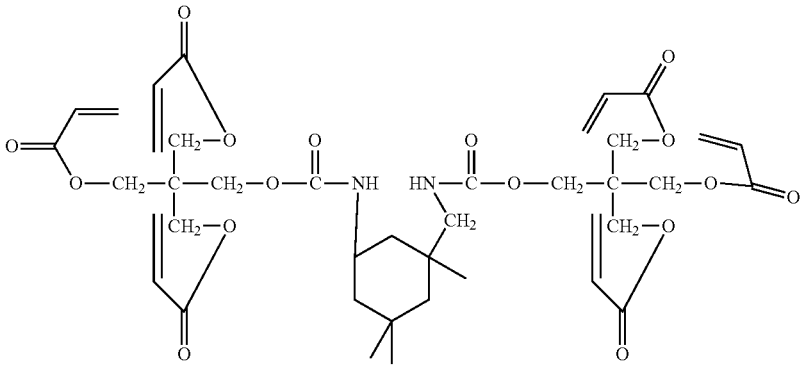

-continued
(L-3)
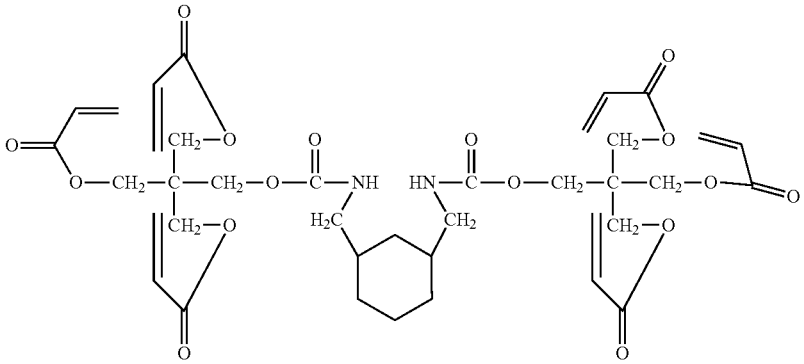
(L-4)
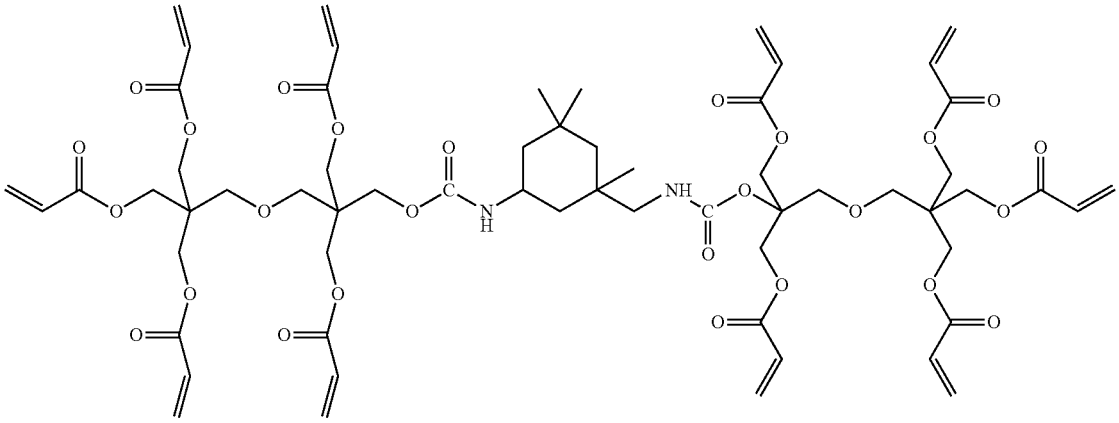
(L-5)
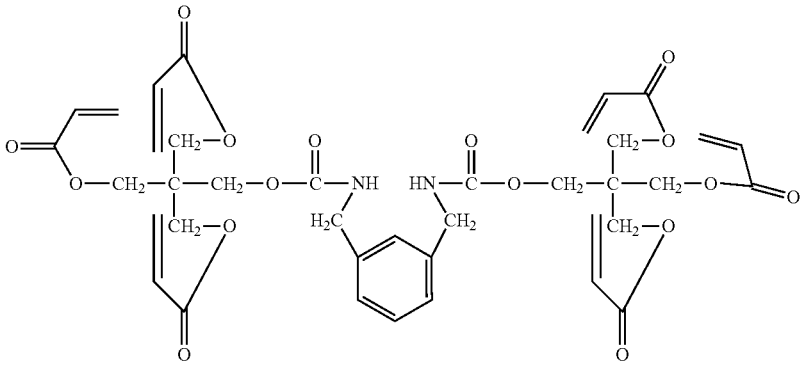
(L-6)
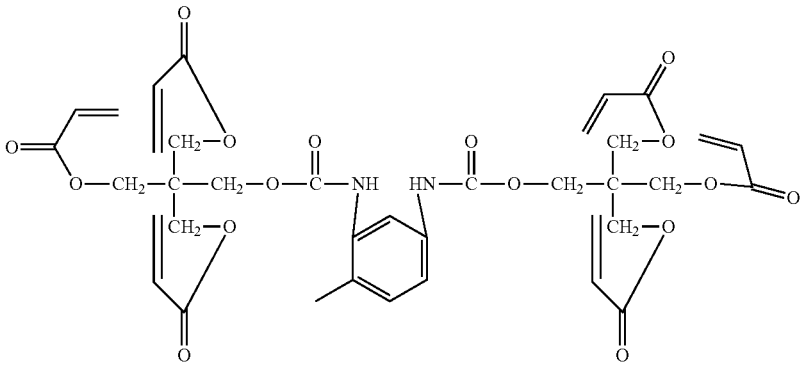

-continued (L-7)

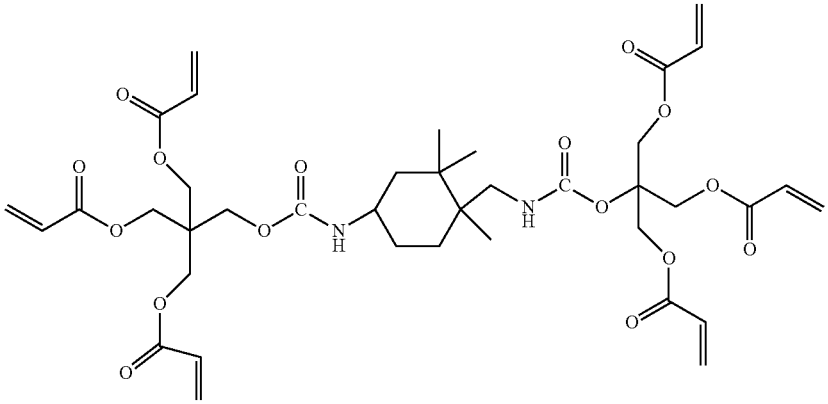

Next, the triphenylamine structure to be incorporated into the protective layer is described. The protective layer needs to have a charge-transporting ability, and hence in the present invention, the triphenylamine structure is caused to exist in the protective layer of the photosensitive member. The triphenylamine structure is preferably incorporated at 20 mass % or more with respect to the total weight of the protective layer in terms of the charge-transporting ability. A compound having a triphenylamine structure may have an acryloyloxy group or a methacryloyloxy group. Specific examples of the compound having a triphenylamine structure, the compound having an acryloyloxy group or a methacryloyloxy group, are shown in the structural formulae (OCL-1) to (OCL-3).

(OCL-1)

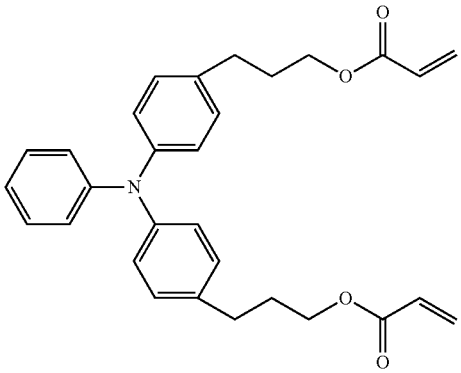

(OCL-2)

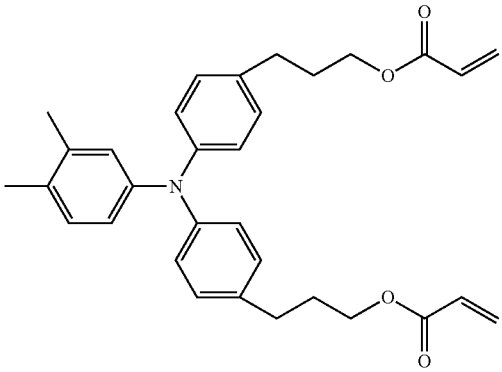

-continued (OCL-3)

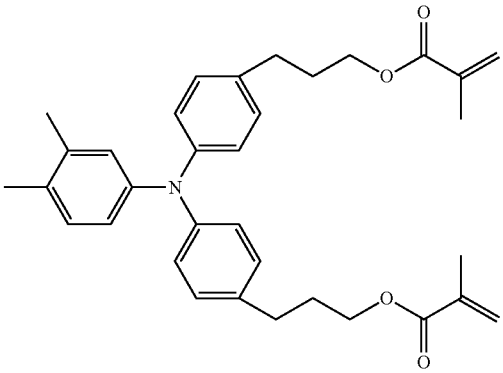

A structure represented by the general formula (5) is preferably incorporated into the protective layer. Material components having the same structure are liable to agglomerate in some cases, and hence in the protective layer, urethane bonds each having large polarity are liable to agglomerate, and other non-polar moieties are liable to agglomerate in some cases. Accordingly, a case in which the structure represented by the general formula (5) is incorporated into the protective layer is preferred because uneven distribution of the same components due to their agglomeration is suppressed by the bulkiness of the structure, and hence the affinity of the surface of the layer becomes more uniform with ease. In addition, the case is preferred because the number of crosslinking points increases to increase the hardness of the protective layer, and hence the scraping-off of the deteriorated fatty acid metal salt with the cleaning blade is facilitated.

(5)

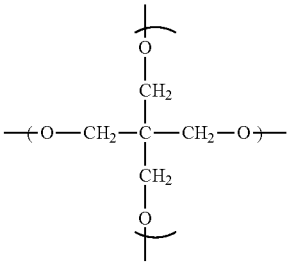

In the present invention, the universal hardness value HU of the protective layer of the electrophotographic photosensitive member is preferably 230 ($N/mm^2$) or more and 260 ($N/mm^2$) or less. A case in which the universal hardness value HU falls within the range is preferred because the deteriorated fatty acid metal salt can be easily scraped off with the cleaning blade.

The universal hardness value HU is measured with a Fischer hardness meter (product name: H100VP-HCU, manufactured by Fischer Instruments K.K.) under an environment having a temperature of 23° C. and a humidity of 50% RH. First, a Vickers quadrangular pyramid diamond indenter having an angle between the opposite faces of 136° is used, and the indenter is indented into the surface of the protective layer serving as a measurement object to apply a load of up to 2 mN over 7 seconds. After that, the load is gradually reduced over 7 seconds, and indentation depths are continuously measured until the load becomes 0 mN. The universal hardness value HU is determined from the measurement results.

In the present invention, the contact angle of the protective layer of the electrophotographic photosensitive member with respect to pure water is preferably 85° or more and 95° or less. When the contact angle is set within the range, the affinity between the surface of the protective layer and the fatty acid metal salt becomes moderate.

In addition, a case in which the protective layer has a siloxane structure or a fluoro group to the extent that its contact angle with respect to pure water does not deviate from the range of from 85° or more to 95° or less is preferred because the deteriorated fatty acid metal salt can be more easily scraped off.

A structure in the protective layer of the electrophotographic photosensitive member according to the present invention may be analyzed by a general analytical approach. For example, the structure may be identified by a measurement method, such as solid 13C-NMR measurement, mass spectrometry measurement, pyrolysis GCMS, or characteristic absorption measurement based on infrared spectroscopic analysis.

The fatty acid metal salt to be used in the present invention needs to have 16 or more and 18 or less carbon atoms. Examples of a higher fatty acid for forming the fatty acid metal salt include palmitic acid, heptadecanoic acid, and stearic acid. In addition, examples of a metal for forming the fatty acid metal salt include zinc, aluminum, calcium, magnesium, iron, and lithium. More specific examples of the fatty acid metal salt may include: palmitic acid metal salts, such as lithium palmitate, sodium palmitate, potassium palmitate, magnesium palmitate, calcium palmitate, and barium palmitate; and stearic acid metal salts, such as lithium stearate, sodium stearate, potassium stearate, magnesium stearate, calcium stearate, barium stearate, and zinc stearate. Of those fatty acid metal salts, zinc stearate is preferred. In addition, the fatty acid metal salts may be used alone or in combination thereof. Further, the fatty acid metal salt may be used in combination with an inorganic lubricant having a cleaving property. Examples of the inorganic lubricant include boron nitride, molybdenum disulfide, tungsten disulfide, talc, kaolin, montmorillonite, calcium fluoride, and mica.

A method of supplying the fatty acid metal salt is, for example, a method involving mounting the electrophotographic photosensitive member on an image-forming apparatus or a process cartridge including a supplying unit configured to supply the fatty acid metal salt to the surface of the electrophotographic photosensitive member, and supplying the fatty acid metal salt with the supplying unit. In addition, the method is, for example, a method involving mounting the electrophotographic photosensitive member on an image-forming apparatus or a process cartridge including a developing unit storing a developer containing the fatty acid metal salt, and supplying the fatty acid metal salt with the developer. For example, a toner containing the fatty acid metal salt may be used as the developer. The toner containing the fatty acid metal salt is, for example, a toner obtained by externally adding the fatty acid metal salt to its toner particles.

When the respective constructions synergistically act on each other like the foregoing mechanism, the effects of the present invention can be achieved.

[Electrophotographic Photosensitive Member]

An electrophotographic photosensitive member according to the present invention has a feature of including a support, a photosensitive layer, and a protective layer.

A method of producing the electrophotographic photosensitive member according to the present invention is, for example, a method involving: preparing coating liquids for the respective layers to be described later; applying the liquids in a desired layer order; and drying the liquids. At this time, a method of applying each of the coating liquids is, for example, dip coating, spray coating, inkjet coating, roll coating, die coating, blade coating, curtain coating, wire bar coating, or ring coating. Of those, dip coating is preferred from the viewpoints of efficiency and productivity.

The respective layers are described below.

<Support>

In the present invention, the electrophotographic photosensitive member includes a support. In the present invention, the support is preferably an electroconductive support having electroconductivity. In addition, examples of the shape of the support include a cylindrical shape, a belt shape, and a sheet shape. Of those, a cylindrical support is preferred. In addition, the surface of the support may be subjected to, for example, an electrochemical treatment, such as anodization, a blast treatment, or a cutting treatment.

A metal, a resin, a glass, or the like is preferred as a material for the support.

Examples of the metal include aluminum, iron, nickel, copper, gold, and stainless steel, and alloys thereof. Of those, an aluminum support using aluminum is preferred.

In addition, electroconductivity may be imparted to the resin or the glass through a treatment involving, for example, mixing or coating the resin or the glass with an electroconductive material.

<Electroconductive Layer>

In the present invention, an electroconductive layer may be arranged on the support. The arrangement of the electroconductive layer can conceal flaws and irregularities in the surface of the support, and control the reflection of light on the surface of the support.

The electroconductive layer preferably contains electroconductive particles and a resin.

A material for the electroconductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the electroconductive particles, and in particular, titanium oxide, tin oxide, and zinc oxide are more preferably used.

When the metal oxide is used as the electroconductive particles, the surface of the metal oxide may be treated with a silane coupling agent or the like, or the metal oxide may be doped with an element, such as phosphorus or aluminum, or an oxide thereof.

In addition, each of the electroconductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the electroconductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the electroconductive layer may further contain a concealing agent, such as a silicone oil, resin particles, or titanium oxide.

The average thickness of the electroconductive layer is preferably 1 μm or more and 50 μm or less, particularly preferably 3 μm or more and 40 μm or less.

The electroconductive layer may be formed by: preparing a coating liquid for an electroconductive layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the electroconductive particles in the coating liquid for an electroconductive layer, there are given methods using a paint shaker, a sand mill, a ball mill, and a liquid collision-type high-speed disperser.

<Undercoat Layer>

In the present invention, an undercoat layer may be arranged on the support or the electroconductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, an electroconductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form an undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The average thickness of the undercoat layer is preferably 0.1 μm or more and 50 μm or less, more preferably 0.2 μm or more and 40 μm or less, particularly preferably 0.3 μm or more and 30 μm or less.

The undercoat layer may be formed by: preparing a coating liquid for an undercoat layer containing the above-mentioned respective materials and a solvent; forming a coat of the liquid; and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of the electrophotographic photosensitive member according to the present invention are mainly classified into (1) a laminated photosensitive layer and (2) a single-layer photosensitive layer. (1) The laminated photosensitive layer has a charge-generating layer containing a charge-generating substance and a charge-transporting layer containing a charge-transporting substance. (2) The single-layer photosensitive layer has a photosensitive layer containing both of the charge-generating substance and the charge-transporting substance.

(1) Laminated Photosensitive Layer

The laminated photosensitive layer has a charge-generating layer and a charge-transporting layer.

(1-1) Charge-generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge-generating layer is preferably 0.1 or more and 1 μm or less, more preferably 0.15 μm or more and 0.4 μm or less.

The charge-generating layer may be formed by: preparing a coating liquid for a charge-generating layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge-transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a sliding property-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the charge-transporting layer is preferably 5 μm or more and 50 μm or less, more preferably 8 μm or more and 40 μm or less, particularly preferably 10 μm or more and 30 μm or less.

The charge-transporting layer may be formed by: preparing a coating liquid for a charge-transporting layer containing the above-mentioned respective materials and a solvent; forming a coat of the liquid; and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-layer Photosensitive Layer

The single-layer photosensitive layer may be formed by: preparing a coating liquid for a photosensitive layer containing the charge-generating substance, the charge-transporting substance, a resin, and a solvent; forming a coat of the liquid; and drying the coat. Examples of the charge-generating substance, the charge-transporting substance, and the resin are the same as the examples of the materials in "(1) Laminated Photosensitive Layer" described above.

<Protective Layer>

The electrophotographic photosensitive member according to the present invention includes the protective layer on the photosensitive layer. The protective layer may be formed as a cured film by polymerizing a composition containing: a monomer containing a triphenylamine structure and an acryloyloxy group or a methacryloyloxy group; and a monomer containing a structure represented by the general formula (1) or (2) and an acryloyloxy group or a methacryloyloxy group. In addition, the composition may contain a monomer having a polymerizable functional group in addition to the monomers having a triphenylamine structure, an acryloyloxy group or a methacryloyloxy group, and a structure represented by the general formula (1) or (2). Examples of the polymerizable functional group of the monomer having a polymerizable functional group include an acrylic group and a methacrylic group. A material having a charge-transporting ability may be used as the monomer having a polymerizable functional group.

The protective layer may contain an additive, such as an antioxidant, a UV absorber, a plasticizer, a leveling agent, a sliding property-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The protective layer may contain electroconductive particles and/or a charge-transporting substance, and a resin.

Examples of the electroconductive particles include particles of metal oxides, such as titanium oxide, zinc oxide, tin oxide, and indium oxide.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

The protective layer may be formed by: preparing a coating liquid for a protective layer containing the above-mentioned respective materials and a solvent; forming a coat of the liquid; and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

A method of curing the coat of the coating liquid for a protective layer is, for example, a method involving curing the coat with heat or a radiation, such as UV light or an electron beam. In order to maintain the strength of the protective layer and the durability of the electrophotographic photosensitive member, the coat is preferably cured with UV light or electron beams. When electron beams are used, the acceleration voltage of the electron beams is preferably 120 kV or less from the viewpoint that the deterioration of the characteristics of the materials due to the electron beams can be suppressed without the impairment of polymerization efficiency. The A-value of the layer may be adjusted by changing the acceleration voltage value or an irradiation time to change the absorbed dose of the electron beams on the surface of the coat of the coating liquid for a protective layer. In addition, in order to suppress a polymerization-inhibiting action caused by oxygen, when the coat is irradiated with electron beams in an inert gas atmosphere, and is then heated in the inert gas atmosphere, the curing may be accelerated. Accordingly, the A-value may also be adjusted by an oxygen concentration or the presence or absence of the heating after the electron beam irradiation. Examples of the inert gas include nitrogen, argon, and helium.

The average thickness of the protective layer is preferably 0.5 μm or more and 10 μm or less, more preferably 1 μm or more and 7 μm or less.

[Process Cartridge and Image-Forming Apparatus]

A process cartridge of the present invention has a feature of integrally supporting the electrophotographic photosensitive member that has been described above, and at least one unit selected from the group consisting of: a charging unit; a developing unit; a cleaning unit; and a fatty acid metal salt-supplying unit, and being removably mounted onto the main body of an image-forming apparatus.

In addition, an image-forming apparatus of the present invention has a feature of including the electrophotographic photosensitive member that has been described above, and a charging unit, an exposing unit, a developing unit, a transferring unit, and a fatty acid metal salt-supplying unit.

An example of the schematic construction of an image-forming apparatus including a process cartridge including an electrophotographic photosensitive member is illustrated in FIGURE.

The electrophotographic photosensitive member 1 having a cylindrical shape is rotationally driven at a predetermined peripheral speed in a direction indicated by the arrow about an axis 2 as a center. The surface of the electrophotographic photosensitive member 1 is charged to a predetermined positive or negative potential by a charging unit 3. In FIGURE, a roller charging system based on a roller-type charging member is illustrated, but a charging system, such as a corona charging system, a proximity charging system, or an injection charging system, may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and hence a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to a treatment for fixing the toner image, and is printed out to the outside of the image-forming apparatus. The image-forming apparatus may include a cleaning unit 9 for removing a deposit, such as the toner remaining on the surface of the electrophotographic photosensitive member 1 after the transfer. The cleaning unit is preferably a cleaning blade containing a urethane resin. In addition, a so-called cleaner-less system configured to remove the deposit with the developing unit 5 or the like without separate arrangement of the cleaning unit 9 may be used. The image-forming apparatus may include an electricity-removing mechanism configured to subject the surface of the electrophotographic photosensitive member 1 to an electricity-removing treatment with pre-exposure light 10 from a pre-exposing unit (not shown). In FIGURE, a fatty acid metal salt-supplying unit 13 is arranged on the rotation upstream side of the cleaning unit 9, but may be arranged at another position. When a toner containing a fatty acid metal salt is used as a developer, the developing unit 5 may be used as the fatty acid metal salt-supplying unit 13 without the arrangement of the fatty acid metal salt-supplying unit 13. In addition, a guiding unit 12, such as a rail, may be arranged for removably mounting a process cartridge 11 of the present invention onto the main body of the image-forming apparatus.

The image-forming apparatus of the present invention may include a laser beam printer, an LED printer, a copying machine, a facsimile, and a multifunctional peripheral thereof.

EXAMPLES

The present invention is described in more detail below by way of Examples and Comparative Examples. The present invention is by no means limited to the following Examples, and various modifications may be made without departing from the gist of the present invention. In the description of the following Examples, "part(s)" is by mass unless otherwise specified.

<Production of Electrophotographic Photosensitive Member>

Example 1

An aluminum cylinder having a diameter of 24 mm and a length of 257 mm (JIS-A3003, aluminum alloy) was used as a support (electroconductive support).

Next, 214 parts of titanium oxide (TiO2) particles coated with oxygen-deficient tin oxide (SnO2) (average primary particle diameter: 230 nm) serving as metal oxide particles, 132 parts of a phenol resin (a monomer or oligomer of a phenol resin) (product name: PLYOPHEN J-325, manufactured by Dainippon Ink & Chemicals, Inc., resin solid content: 60 mass %) serving as a binding material, and 98 parts of 1-methoxy-2-propanol serving as a solvent were loaded into a sand mill using 450 parts of glass beads each having a diameter of 0.8 mm, and were subjected to a dispersion treatment under the conditions of a number of revolutions of 2,000 rpm, a dispersion treatment time of 4.5 hours, and a preset temperature of cooling water of 18° C. to provide a dispersion liquid. The glass beads were removed from the dispersion liquid with a mesh (aperture: 150 μm). Silicone resin particles (product name: TOSPEARL 120, manufactured by Momentive Performance Materials, average particle diameter: 2 μm) serving as a surface roughness-imparting material were added to the dispersion liquid so that their content became 10 mass % with respect to the total mass of the metal oxide particles and the binding material in the dispersion liquid after the removal of the glass beads. In addition, a silicone oil (product name: SH28PA, manufactured by Dow Corning Toray Co., Ltd.) serving as a leveling agent was added to the dispersion liquid so that its content became 0.01 mass % with respect to the total mass of the metal oxide particles and the binding material in the dispersion liquid. Next, a mixed solvent of methanol and 1-methoxy-2-propanol (mass ratio: 1:1) was added to the dispersion liquid so that the total mass of the metal oxide particles, the binding material, and the surface roughness-imparting material (i.e., the mass of the solid content) in the dispersion liquid became 67 mass % with respect to the mass of the dispersion liquid, followed by stirring. Thus, a coating liquid for an electroconductive layer was prepared. The coating liquid for an electroconductive layer was applied onto the support by dip coating, and was heated for 1 hour at 140° C. to form an electroconductive layer having a thickness of 30 μm.

Next, a coating liquid for an undercoat layer was prepared by dissolving 4 parts of an electron-transporting substance represented by the structural formula (E-1), 5.5 parts of a blocked isocyanate (product name: DURANATE SBN-70D, manufactured by Asahi Kasei Chemicals Corporation), 0.3 part of a polyvinyl butyral resin (S-LEC KS-5Z, manufactured by Sekisui Chemical Co., Ltd.), and 0.05 part of zinc(II) hexanoate (manufactured by Mitsuwa Chemicals Co., Ltd.) serving as a catalyst in a mixed solvent of 50 parts of tetrahydrofuran and 50 parts of 1-methoxy-2-propanol. The coating liquid for an undercoat layer was applied onto the electroconductive layer by dip coating, and was heated for 30 minutes at 170° C. to form an undercoat layer having a thickness of 0.7 μm (E-1)

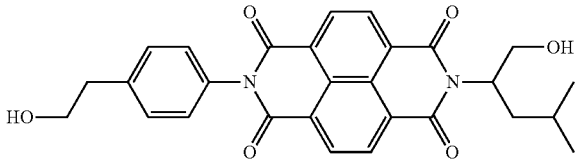

Next, 10 parts of hydroxygallium phthalocyanine of a crystal form having peaks at positions of 7.5° and 28.4° in a chart obtained by CuKα characteristic X-ray diffraction, and 5 parts of a polyvinyl butyral resin (product name: S-LEC BX-1, manufactured by Sekisui Chemical Co., Ltd.) were added to 200 parts of cyclohexanone, and the materials were dispersed with a sand mill apparatus using glass beads each having a diameter of 0.9 mm for 6 hours. 150 Parts of cyclohexanone and 350 parts of ethyl acetate were further added to the dispersed product to dilute the product. Thus, a coating liquid for a charge-generating layer was obtained. The resultant coating liquid was applied onto the undercoat layer by dip coating, and was dried at 95° C. for 10 minutes to form a charge-generating layer having a thickness of 0.20 The X-ray diffraction measurement was performed under the following conditions.

[Powder X-ray Diffraction Measurement]

Measurement device used: X-ray diffraction apparatus RINT-TTR II manufactured by Rigaku Denki Co., Ltd.

X-ray tube bulb: Cu

Tube voltage: 50 KV

Tube current: 300 mA

Scan method: 2 θ/θ scan

Scan rate: 4.0°/min

Sampling interval: 0.02°

Start angle (2θ): 5.0°

Stop angle (2θ): 40.0°

Attachment: standard sample holder

Filter: not used

Incident monochrometer: used

Counter monochrometer: not used

Divergence slit: open

Divergence vertical restriction slit: 10.00 mm

Scattering slit: open

Light reception slit: open

Flat plate monochrometer: used

Counter: scintillation counter

Next, a coating liquid for a charge-transporting layer was prepared by dissolving 6 parts of a charge-transporting substance (hole-transportable substance) represented by the structural formula (C-1), 3 parts of a charge-transporting substance (hole-transportable substance) represented by the structural formula (C-2), 1 part of a charge-transporting substance (hole-transportable substance) represented by the structural formula (C-3), 10 parts of a polycarbonate (product name: IUPILON Z400, manufactured by Mitsubishi Engineering-Plastics Corporation), and 0.02 part of a polycarbonate resin having copolymerization units represented by the structural formula (C-4) and the structural formula (C-5) (x/y=9/1, Mv=20,000) in a mixed solvent of 25 parts of o-xylene, 25 parts of methyl benzoate, and 25 parts of dimethoxymethane. The coating liquid for a charge-transporting layer was applied onto the charge-generating layer by dip coating to form a coat, and the coat was dried for 30 minutes at 120° C. to form a charge-transporting layer having a thickness of 12 μm.

(C-1)

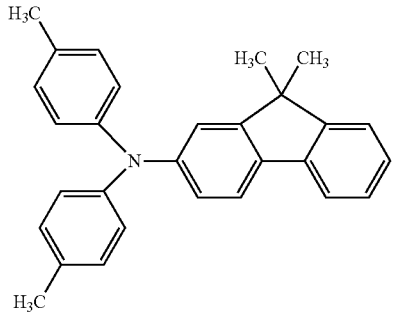

(C-2)

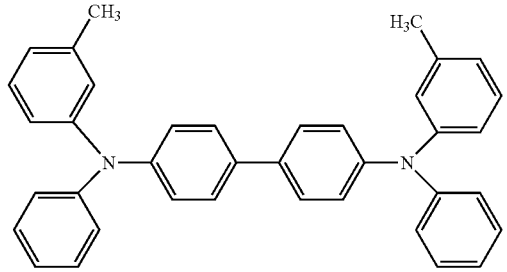

(C-3)

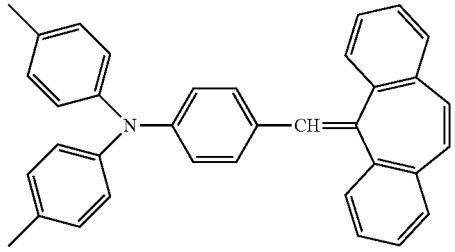

-continued (C-4)

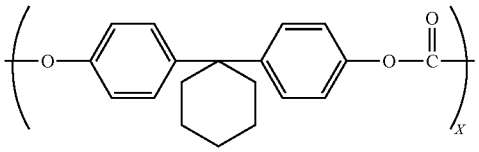

(C-5)

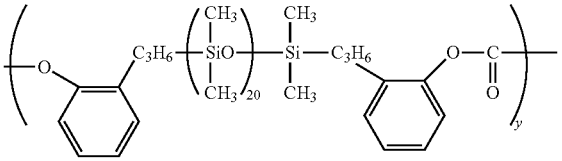

Next, 10.0 parts of the compound represented by the structural formula (OCL-1) and 2.5 parts of the compound represented by the structural formula (L-1) were mixed with a mixed solvent of 72 parts of 2-propanol and 8 parts of tetrahydrofuran, and the mixture was stirred. Thus, a coating liquid for a protective layer was prepared. The coating liquid for a protective layer was applied onto the charge-transporting layer by dip coating to form a coat, and the resultant coat was dried for 6 minutes at 50° C. After that, under a nitrogen atmosphere, the coat was irradiated with electron beams for 1.4 seconds under the conditions of an acceleration voltage of 70 kV and a beam current of 4.0 mA while the support (body to be irradiated) was rotated at a speed of 300 rpm. An oxygen concentration at the time of the electron beam irradiation was 200 ppm. Next, the coat was naturally cooled in air until its temperature became 25° C. After that, a heating treatment was performed for 1 hour under such a condition that the temperature of the coat became 120° C. Thus, a protective layer having a thickness of 3 μm was formed. Thus, a cylindrical (drum-shaped) photosensitive member of Example 1 having the protective layer was produced.

Examples 2 to 29 and Comparative Examples 1 to 14

Photosensitive members were each produced in the same manner as in Example 1 except that in Example 1, the kind and amount of the compound represented by the structural formula (OCL-1), and the kind and amount of the compound represented by the structural formula (L-1) were changed as shown in Table 1. Electron beam irradiation conditions are shown in Table 2 below.

Example 30

10.0 Parts of the compound represented by the structural formula (OCL-1), 10.2 parts of the compound represented by the structural formula (L-1), and 0.2 part of a siloxane-modified acrylic compound (BYK-3550, manufactured by BYK-Chemie Japan K.K.) were mixed with a mixed solvent of 72 parts of 2-propanol and 8 parts of tetrahydrofuran, and the mixture was stirred. Thus, a coating liquid for a protective layer was prepared.

A photosensitive member of Example 30 was produced in the same manner as in Example 1 by using the coating liquid for a protective layer. Electron beam irradiation conditions are shown in Table 2 below.

Example 31

A photosensitive member of Example 31 was produced in the same manner as in Example 30 except that in Example 30, 0.2 part of the siloxane-modified acrylic compound (BYK-3550, manufactured by BYK-Chemie Japan K.K.) was changed to 0.2 part of a fluorine atom-containing resin (product name: GF-400, manufactured by Toagosei Co., Ltd.).

TABLE 1

| | Compound having triphenylamine structure | | Urethane acrylate | | Content of (1') | | Contact | HU |
|---|---|---|---|---|---|---|---|---|
| | Structure | Part(s) by mass | Structure | Part(s) by mass | or (2') [mass %] | A-value | angle [°] | [N/mm$^2$] |
| Example 1 | OCL-1 | 10.0 | L-1 | 2.5 | 10.0 | 0.057 | 96 | 220 |
| Example 2 | OCL-1 | 10.0 | L-1 | 3.7 | 13.6 | 0.050 | 86 | 228 |
| Example 3 | OCL-1 | 10.0 | L-1 | 6.6 | 20.0 | 0.058 | 88 | 228 |
| Example 4 | OCL-1 | 10.0 | L-1 | 3.7 | 13.6 | 0.020 | 83 | 260 |
| Example 5 | OCL-1 | 10.0 | L-1 | 3.7 | 13.6 | 0.031 | 83 | 240 |
| Example 6 | OCL-1 | 10.0 | L-1 | 3.7 | 13.6 | 0.040 | 83 | 235 |
| Example 7 | OCL-1 | 10.0 | L-1 | 3.7 | 13.6 | 0.075 | 88 | 213 |
| Example 8 | OCL-1 | 10.0 | L-2 | 5.8 | 10.0 | 0.059 | 96 | 229 |
| Example 9 | OCL-1 | 10.0 | L-2 | 7.9 | 12.0 | 0.058 | 91 | 245 |
| Example 10 | OCL-1 | 10.0 | L-2 | 10.0 | 13.6 | 0.020 | 88 | 265 |
| Example 11 | OCL-1 | 10.0 | L-2 | 10.0 | 13.6 | 0.030 | 88 | 260 |
| Example 12 | OCL-1 | 10.0 | L-2 | 10.0 | 13.6 | 0.040 | 88 | 260 |
| Example 13 | OCL-1 | 10.0 | L-2 | 10.0 | 13.6 | 0.048 | 90 | 250 |
| Example 14 | OCL-2 | 10.0 | L-2 | 10.0 | 13.6 | 0.052 | 90 | 246 |
| Example 15 | OCL-3 | 10.0 | L-2 | 10.0 | 13.6 | 0.051 | 91 | 245 |
| Example 16 | OCL-1 | 10.0 | L-2 | 10.0 | 13.6 | 0.057 | 91 | 246 |
| Example 17 | OCL-2 | 10.0 | L-2 | 10.0 | 13.6 | 0.063 | 90 | 240 |
| Example 18 | OCL-1 | 10.0 | L-2 | 10.0 | 13.6 | 0.067 | 89 | 241 |
| Example 19 | OCL-1 | 10.0 | L-2 | 10.0 | 13.6 | 0.075 | 86 | 229 |
| Example 20 | OCL-1 | 10.0 | L-2 | 28.0 | 20.0 | 0.059 | 88 | 244 |
| Example 21 | OCL-2 | 10.0 | L-2 | 14.4 | 16.0 | 0.058 | 88 | 242 |
| Example 22 | OCL-1 | 10.0 | L-3 | 12.4 | 13.6 | 0.056 | 83 | 245 |
| Example 23 | OCL-1 | 10.0 | L-5 | 10.0 | 12.0 | 0.058 | 84 | 240 |
| Example 24 | OCL-1 | 10.0 | L-6 | 15.8 | 13.6 | 0.050 | 85 | 250 |
| Example 25 | OCL-1 | 10.0 | L-4 | 33.3 | 13.6 | 0.057 | 93 | 288 |
| Example 26 | OCL-1 | 10.0 | L-2 | 10.0 | 13.6 | 0.058 | 91 | 246 |
| Example 27 | OCL-1 | 10.0 | L-2 | 10.0 | 13.6 | 0.059 | 91 | 246 |

TABLE 1-continued

| | Compound having triphenylamine structure | | Urethane acrylate | | Content of (1') | | Contact | HU |
|---|---|---|---|---|---|---|---|---|
| | Structure | Part(s) by mass | Structure | Part(s) by mass | or (2') [mass %] | A-value | angle [°] | [N/mm$^2$] |
| Example 28 | OCL-1 | 10.0 | L-2 | 10.0 | 13.6 | 0.056 | 91 | 246 |
| Example 29 | OCL-1 | 10.0 | L-2 | 10.0 | 13.6 | 0.058 | 91 | 246 |
| Example 30 | OCL-1 | 10.0 | L-2 | 10.2 | 13.6 | 0.058 | 94 | 250 |
| Example 31 | OCL-1 | 10.0 | L-2 | 10.2 | 13.6 | 0.056 | 94 | 255 |
| Comparative Example 1 | OCL-1 | 10.0 | L-1 | 1.9 | 8.0 | 0.051 | 96 | 220 |
| Comparative Example 2 | OCL-1 | 10.0 | L-1 | 7.7 | 22.0 | 0.050 | 86 | 228 |
| Comparative Example 3 | OCL-1 | 10.0 | L-1 | 3.1 | 12.0 | 0.015 | 83 | 240 |
| Comparative Example 4 | OCL-1 | 10.0 | L-1 | 3.1 | 12.0 | 0.084 | 86 | 215 |
| Comparative Example 5 | OCL-1 | 10.0 | L-2 | 4.2 | 8.0 | 0.051 | 96 | 229 |
| Comparative Example 6 | OCL-1 | 10.0 | L-2 | 42.8 | 22.0 | 0.050 | 88 | 234 |
| Comparative Example 7 | OCL-1 | 10.0 | L-2 | 7.9 | 12.0 | 0.017 | 84 | 245 |
| Comparative Example 8 | OCL-1 | 10.0 | L-2 | 7.9 | 12.0 | 0.082 | 88 | 225 |
| Comparative Example 9 | OCL-1 | 10.0 | L-1 | 3.1 | 12.0 | 0.050 | 88 | 228 |
| Comparative Example 10 | OCL-1 | 10.0 | L-1 | 3.1 | 12.0 | 0.016 | 83 | 240 |
| Comparative Example 11 | OCL-1 | 10.0 | L-1 | 3.1 | 12.0 | 0.049 | 86 | 228 |
| Comparative Example 12 | OCL-1 | 10.0 | L-2 | 10.0 | 13.6 | 0.058 | 91 | 246 |
| Comparative Example 13 | OCL-1 | 10.0 | L-1 | 3.1 | 12.0 | 0.084 | 86 | 215 |
| Comparative Example 14 | OCL-1 | 10.0 | L-7 | 7.9 | 12.0 | 0.030 | 83 | 240 |

TABLE 2

| | Electron beam irradiation condition | | | | |
|---|---|---|---|---|---|
| | Oxygen concentration [ppm] | Voltage value [kV] | Current value [mA] | Irradiation time [s] | Heating temperature [° C.] |
| Example 1 | 200 | 70 | 4 | 1.4 | 120 |
| Example 2 | 55 | 70 | 5 | 1.6 | 120 |
| Example 3 | 200 | 70 | 4 | 1.4 | 120 |
| Example 4 | 10 | 70 | 5 | 1.6 | 120 |
| Example 5 | 250 | 70 | 5 | 1.6 | 120 |
| Example 6 | 25 | 70 | 5 | 1.6 | 120 |
| Example 7 | 560 | 70 | 5 | 1.6 | 120 |
| Example 8 | 200 | 70 | 4 | 1.4 | 120 |
| Example 9 | 200 | 70 | 4 | 1.4 | 120 |
| Example 10 | 10 | 70 | 5 | 1.6 | 120 |
| Example 11 | 250 | 70 | 5 | 1.6 | 120 |
| Example 12 | 25 | 70 | 5 | 1.6 | 120 |
| Example 13 | 15 | 70 | 2 | 0.4 | 120 |
| Example 14 | 55 | 70 | 5 | 1.6 | 120 |
| Example 15 | 55 | 70 | 5 | 1.6 | 120 |
| Example 16 | 200 | 70 | 4 | 1.4 | 120 |
| Example 17 | 500 | 90 | 3 | 1.2 | 120 |
| Example 18 | 320 | 70 | 5 | 1.6 | 120 |
| Example 19 | 560 | 70 | 5 | 1.6 | 120 |
| Example 20 | 200 | 70 | 4 | 1.4 | 120 |
| Example 21 | 200 | 70 | 4 | 1.4 | 120 |
| Example 22 | 200 | 70 | 4 | 1.4 | 120 |
| Example 23 | 200 | 70 | 4 | 1.4 | 120 |
| Example 24 | 55 | 70 | 5 | 1.6 | 120 |
| Example 25 | 200 | 70 | 4 | 1.4 | 120 |
| Example 26 | 200 | 70 | 4 | 1.4 | 120 |
| Example 27 | 200 | 70 | 4 | 1.4 | 120 |
| Example 28 | 200 | 70 | 4 | 1.4 | 120 |
| Example 29 | 200 | 70 | 4 | 1.4 | 120 |

TABLE 2-continued

| | Electron beam irradiation condition | | | | |
|---|---|---|---|---|---|
| | Oxygen concentration [ppm] | Voltage value [kV] | Current value [mA] | Irradiation time [s] | Heating temperature [° C.] |
| Example 30 | 200 | 70 | 4 | 1.4 | 120 |
| Example 31 | 200 | 70 | 4 | 1.4 | 120 |
| Comparative Example 1 | 55 | 70 | 5 | 1.6 | 120 |
| Comparative Example 2 | 55 | 70 | 5 | 1.6 | 120 |
| Comparative Example 3 | 10 | 120 | 12 | 2.4 | 120 |
| Comparative Example 4 | 810 | 70 | 2 | 1.6 | 120 |
| Comparative Example 5 | 55 | 70 | 5 | 1.6 | 120 |
| Comparative Example 6 | 55 | 70 | 5 | 1.6 | 120 |
| Comparative Example 7 | 10 | 120 | 12 | 2.4 | 120 |
| Comparative Example 8 | 810 | 70 | 2 | 1.6 | 120 |
| Comparative Example 9 | 55 | 70 | 5 | 1.6 | 120 |
| Comparative Example 10 | 10 | 120 | 12 | 2.4 | 120 |
| Comparative Example 11 | 55 | 70 | 5 | 1.6 | 120 |
| Comparative Example 12 | 200 | 70 | 4 | 1.4 | 120 |
| Comparative Example 13 | 810 | 70 | 2 | 1.6 | 120 |
| Comparative Example 14 | 250 | 70 | 5 | 1.6 | 120 |

<Analysis>

Analysis was performed by using the photosensitive members of Examples 1 to 31 and the photosensitive members of Comparative Examples 1 to 14 thus produced under the following conditions.

A protective layer was peeled by shaving off the surface of each of the resultant photosensitive members with a razor. First, the protective layer was immersed in chloroform. The protective layer insoluble in chloroform was removed and dried, and then measurement based on pyrolysis GCMS was performed by the following procedure. A TMAH methylating agent and the sample were subjected to pyrolysis with a pyrolyzer (product name: JPS-700, manufactured by Japan Analytical Industry Co., Ltd.), and the sample was introduced into a GCMS (product name: ISQ (FOCUS GC), manufactured by Thermo Fisher Scientific K.K.), followed by the performance of analysis. In addition, also when the TMAH methylating agent was not used, the same analysis was performed. A triphenylamine structure and an acryloyloxy group or a methacryloyloxy group were detected by the measurement. In addition, in the analysis in which the TMAH methylating agent was not used, the content of a structure represented by the general formula (1') or (2') with respect to the total weight of the protective layer was determined by drawing a calibration curve through the use of a commercial preparation.

In addition, the elastic deformation ratio of the protective layer was measured with a Fischer hardness meter (product name: H100VP-HCU, manufactured by Fischer Instruments K.K.) under an environment having a temperature of 23° C. and a humidity of 50% RH. A Vickers quadrangular pyramid diamond indenter having an angle between the opposite faces of 136° was used as an indenter, and the diamond indenter was indented into the surface of the protective layer serving as a measurement object to apply a load of up to 2 mN over 7 seconds. After that, the load was gradually reduced over 7 seconds, and indentation depths were continuously measured until the load became 0 mN. The universal hardness value HU of the layer was determined from the results.

Next, the infrared spectroscopy spectrum of the surface of the photosensitive member was measured by using a Fourier transform infrared spectroscopy total reflection method under the following conditions, followed by the determination of its A-value. S1 was defined as a peak area in the range of from 1,413 cm-1 to 1,400 cm-1, and S2 was defined as a peak area in the range of from 1,770 cm-1 to 1,700 cm-1.

(Measurement Condition)

Apparatus: FT/IR-420 (manufactured by JASCO Corporation)

Attachment: ATR apparatus

Internal reflection element (IRE): Ge

Incident angle: 45°

Number of scans: 320 times

Those analysis results are shown in Table 1.

<Evaluation>

Black spots and black stripes were evaluated by using the photosensitive members produced in Examples 1 to 25, 30, and 31, and the photosensitive members produced in Comparative Examples 1 to 8 and 14 under the following conditions.

A reconstructed machine of a laser beam printer available under the product name "HP LaserJet Enterprise Color M553dn" from Hewlett-Packard Company was used as an image-forming apparatus. The printer was reconstructed as described below. A fatty acid metal salt-supplying member was mounted on a process cartridge. Zinc stearate was used as a fatty acid metal salt. The position at which the member was mounted was arranged on an upstream side in the rotation direction of each of the photosensitive members with respect to a cleaning blade. In addition, the printer was reconstructed so that the regulation and measurement of a voltage to be applied to a charging roller, and the regulation and measurement of an image exposure light quantity could be performed.

First, the image-forming apparatus and the photosensitive members were left to stand in an environment having a temperature of 15° C. and a humidity of 10% RH for 24 hours or more, and then the photosensitive member of each of Examples and Comparative Examples was mounted on the cartridge for a cyan color of the image-forming apparatus.

Next, the voltage to be applied was set so that a charging potential Vd of the photosensitive member became −700 V. Next, a solid image was output on A4 size plain paper with a cyan color alone, and the image exposure light quantity was set so that its density on the paper measured with a spectral densitometer (product name: X-Rite 504, manufactured by X-Rite, Inc.) became 1.45.

Next, an image evaluation was performed. In a sheet passing endurance test, a letter image having a print percentage of 1% was output on 10,000 sheets of letter paper with a cyan color alone by performing a printing operation in an intermittent mode. After that, the laser beam printer was replenished with a toner for the laser beam printer, and the image was further output on 10,000 sheets (i.e., the image was output on a total of 20,000 sheets).

Then, samples (a halftone image and a solid white image) for an image evaluation were output on 1 sheet at each of the time of the completion of the output of the image on 10,000 sheets and the time of the completion of the output of the image on 20,000 sheets. The black spots and black stripes of the output images were visually observed, and were evaluated by the following criteria. The used fatty acid metal salts and the results are shown in Table 3.

Evaluation ranks were set as described below.

Rank 5: The number of black spots is 0, and the number of black stripes is 0.

Rank 4: The number of black spots is 1 or 2, and the number of black stripes is 0.

Rank 3: The number of black spots is 3, and the number of black stripes is 0.

Rank 2: The number of black spots is from 4 to 6, or the number of black stripes is 1.

Rank 1: The number of black spots is 7 or more, or the number of black stripes is 2 or more.

TABLE 3

| | Fatty acid metal salt | After image output on 10,000 sheets | After image output on 20,000 sheets |
|---|---|---|---|
| Example 1 | Zinc stearate | 4 | 3 |
| Example 2 | Zinc stearate | 4 | 3 |
| Example 3 | Zinc stearate | 5 | 3 |
| Example 4 | Zinc stearate | 4 | 3 |
| Example 5 | Zinc stearate | 4 | 3 |
| Example 6 | Zinc stearate | 4 | 3 |
| Example 7 | Zinc stearate | 4 | 3 |
| Example 8 | Zinc stearate | 4 | 4 |
| Example 9 | Zinc stearate | 5 | 4 |
| Example 10 | Zinc stearate | 5 | 4 |
| Example 11 | Zinc stearate | 5 | 4 |
| Example 12 | Zinc stearate | 5 | 4 |
| Example 13 | Zinc stearate | 5 | 4 |
| Example 14 | Zinc stearate | 5 | 5 |

TABLE 3-continued

| | Fatty acid metal salt | After image output on 10,000 sheets | After image output on 20,000 sheets |
|---|---|---|---|
| Example 15 | Zinc stearate | 5 | 4 |
| Example 16 | Zinc stearate | 5 | 5 |
| Example 17 | Zinc stearate | 5 | 4 |
| Example 18 | Zinc stearate | 5 | 4 |
| Example 19 | Zinc stearate | 5 | 4 |
| Example 20 | Zinc stearate | 5 | 4 |
| Example 21 | Zinc stearate | 5 | 4 |
| Example 22 | Zinc stearate | 5 | 4 |
| Example 23 | Zinc stearate | 4 | 4 |
| Example 24 | Zinc stearate | 4 | 4 |
| Example 25 | Zinc stearate | 5 | 4 |
| Example 26 | Zinc palmitate | 5 | 4 |
| Example 27 | Zinc stearate + Zinc palmitate | 5 | 4 |
| Example 28 | Ca stearate | 5 | 4 |
| Example 29 | Zinc stearate Supplied from toner | 5 | 4 |
| Example 30 | Zinc stearate | 5 | 5 |
| Example 31 | Zinc stearate | 5 | 5 |
| Comparative Example 1 | Zinc stearate | 3 | 2 |
| Comparative Example 2 | Zinc stearate | 3 | 2 |
| Comparative Example 3 | Zinc stearate | 3 | 2 |
| Comparative Example 4 | Zinc stearate | 3 | 2 |
| Comparative Example 5 | Zinc stearate | 3 | 2 |
| Comparative Example 6 | Zinc stearate | 3 | 2 |
| Comparative Example 7 | Zinc stearate | 3 | 2 |
| Comparative Example 8 | Zinc stearate | 3 | 2 |
| Comparative Example 9 | Zinc laurate | 2 | 2 |
| Comparative Example 10 | No supply | 2 | 2 |
| Comparative Example 11 | No supply | 2 | 2 |
| Comparative Example 12 | No supply | 2 | 2 |
| Comparative Example 13 | No supply | 2 | 2 |
| Comparative Example 14 | Zinc stearate | 3 | 2 |

<Evaluations of Photosensitive Member of Example 26>

Evaluations were performed in the same manner as in the photosensitive member of Example 1 except that the kind of the fatty acid metal salt was changed to zinc palmitate. The used fatty acid metal salt and the results are shown in Table 3.

<Evaluations of Photosensitive Member of Example 27>

Evaluations were performed in the same manner as in the photosensitive member of Example 1 except that the kind of the fatty acid metal salt was changed to the following two kinds: zinc stearate and zinc palmitate. The used fatty acid metal salts and the results are shown in Table 3.

<Evaluations of Photosensitive Member of Example 28>

Evaluations were performed in the same manner as in the photosensitive member of Example 1 except that the kind of the fatty acid metal salt was changed to calcium stearate. The used fatty acid metal salt and the results are shown in Table 3.

<Evaluations of Photosensitive Member of Example 29>

Evaluations were performed in the same manner as in the photosensitive member of Example 1 except that: the fatty acid metal salt-supplying member was removed; and the toner for the laser beam printer was changed to a toner obtained by additionally externally adding 0.2 mass % of zinc stearate with respect to the weight of its toner particles. The used fatty acid metal salt and the results are shown in Table 3.

<Evaluations of Photosensitive Member of Comparative Example 9>

Evaluations were performed in the same manner as in the photosensitive member of Example 1 except that the kind of the fatty acid metal salt was changed to zinc laurate. The results are shown in Table 3.

<Evaluations of Photosensitive Members of Comparative Examples 10 to 13>

Evaluations were performed in the same manner as in the photosensitive member of Example 1 except that the fatty acid metal salt-supplying member was removed. The used fatty acid metal salts and the results are shown in Table 3.

Example 32

10.0 Parts of the compound represented by the structural formula (OCL-1), 13.6 parts of the compound represented by the structural formula (L-1), and 1 part of 1-hydroxycyclohexyl phenyl ketone represented by the structural formula (7) were mixed with a mixed solvent of 72 parts of 2-propanol and 8 parts of tetrahydrofuran, and the mixture was stirred. Thus, a coating liquid for a protective layer was prepared.

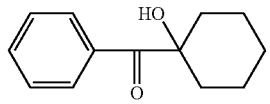

(7)

The coating liquid for a protective layer was applied onto the charge-transporting layer of a photosensitive member for which the process up to the formation of the charge-transporting layer had been performed in the same manner as in Example 1 by dip coating to form a coat, and the resultant coat was dried for 6 minutes at 50° C. After that, the coat was irradiated with UV light for 10 seconds by using an electrodeless lamp "H BULB" (manufactured by Heraeus K.K.) under the condition of a lamp intensity of 0.6 W/cm2 while the support (body to be irradiated) was rotated at a speed of 300 rpm. Next, the coat was naturally cooled until its temperature became 25° C., and then a heating treatment was performed for 1 hour under such a condition that the temperature of the coat became 120° C. Thus, a protective layer having a thickness of 3 μm was formed. Thus, a photosensitive member was produced.

Example 33

A photosensitive member of Example 33 was produced in the same manner as in Example 32 except that: the lamp intensity was changed to 0.4 W/cm2; and the irradiation time was changed to 3 seconds.

Comparative Example 15

A coating liquid for a protective layer was prepared by dissolving 9 parts of trimethylolpropane triacrylate (product name: KAYARAD TMPTA, manufactured by Nippon Kayaku Co., Ltd.) serving as a radical-polymerizable monomer, 9 parts of a charge-transporting compound having a polymerizable functional group represented by the structural formula (OCL-4), and 2 parts of 1-hydroxycyclohexyl phenyl ketone (product name: IRGACURE 184, manufactured by Ciba Specialty Chemicals) serving as a polymerization initiator in 100 parts of tetrahydrofuran. The coating liquid for a protective layer was applied onto the charge-transporting layer of a photosensitive member for which the process up to the formation of the charge-transporting layer had been performed in the same manner as in Example 1 with a spray, and the coat was irradiated with light for 50 seconds by using a metal halide lamp having an irradiation intensity of 0.6 W/cm2. After that, the coat was dried for 30 minutes at 130° C. to form a protective layer having a thickness of 5 μm . Thus, a photosensitive member of Comparative Example 15 was produced.

(OCL-4)

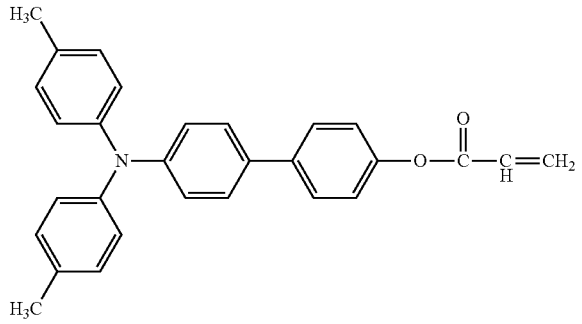

Comparative Example 16

In Example 32, a photosensitive member was produced in the same manner as in Example 32 except that: the lamp intensity was changed to 0.3 W/cm2; and the irradiation time was changed to 2 seconds.

<UV Irradiation Condition>

Conditions for the irradiation of the photosensitive members produced in Examples 32 and 33, and the photosensitive members produced in Comparative Examples 15 and 16 with UV light are shown in Table 4 below.

TABLE 4

| | UV irradiation condition | | |
|---|---|---|---|
| | Lamp intensity [W/cm$^2$] | Irradiation time [s] | Heating temperature [° C.] |
| Example 32 | 0.6 | 10 | 120 |
| Example 33 | 0.4 | 3 | 120 |
| Comparative Example 15 | 0.6 | 50 | 130 |
| Comparative Example 16 | 0.3 | 2 | 120 |

<Analysis>

The photosensitive members produced in Examples 32 and 33, and the photosensitive members produced in Comparative Examples 15 and 16 were each analyzed in the same manner as in the photosensitive member of Example 1. Analysis results are shown in Table 5.

TABLE 5

| | Compound having triphenylamine structure | | Urethane acrylate | | Content of (1') or (2') [mass %] | A-value | Contact angle [°] | HU [N/mm$^2$] |
|---|---|---|---|---|---|---|---|---|
| | Structure | Part(s) by mass | Structure | Part(s) by mass | | | | |
| Example 32 | OCL-1 | 10.0 | L-2 | 13.6 | 15 | 0.056 | 83 | 240 |
| Example 33 | OCL-1 | 10.0 | L-2 | 13.6 | 15 | 0.074 | 82 | 235 |
| Comparative Example 15 | OCL-4 | 9.0 | — | — | — | 0.045 | 96 | 280 |
| Comparative Example 16 | OCL-1 | 10.0 | L-2 | 10.0 | 13.6 | 0.084 | 83 | 235 |

<Evaluation>

The photosensitive members of Examples 32 and 33, and the photosensitive members of Comparative Examples 15 and 16 thus produced were each evaluated in the same manner as in the photosensitive member of Example 1. The used fatty acid metal salts and the results are shown in Table 6.

TABLE 6

| | Fatty acid metal salt | After image output on 10,000 sheets | After image output on 20,000 sheets |
|---|---|---|---|
| Example 32 | Zinc stearate | 5 | 4 |
| Example 33 | Zinc stearate | 5 | 4 |
| Comparative Example 15 | Zinc stearate | 3 | 2 |
| Comparative Example 16 | Zinc stearate | 2 | 2 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-35738, filed Feb. 28, 2018, which is hereby incorporated by reference herein in its entirety.

What is claimed is:

1. An image-forming apparatus comprising:

an electrophotographic photosensitive member including a support, a photosensitive layer, and a protective layer in this order;

a charging unit configured to charge the electrophotographic photosensitive member;

an exposing unit configured to expose the electrophotographic photosensitive member to light to form an electrostatic latent image;

a developing unit configured to develop the electrostatic latent image with a toner to form a toner image;

a transferring unit configured to transfer the toner image from the electrophotographic photosensitive member onto a transfer material; and a cleaning unit configured to clean with a cleaning blade toner that remains on the electrophotographic photosensitive member after transferring the toner image from the electrophotographic photosensitive member by the transferring unit, a unit storing a fatty acid metal salt having 16 to 18 carbon atoms, and a fatty acid metal salt-supplying unit configured to supply the fatty acid metal salt to a surface of the protective layer, wherein, the protective layer comprises a resin having a triphenylamine structure, and a structure represented by one of formulae (1) and (2):

(1)

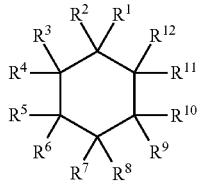

where at least two of $R^1$, $R^5$ and $R^9$ represents a structure represented by formula (3), and each of the substituents except the substituents represented by formula (3) in $R^1$ to $R^{12}$ is a hydrogen atom or a methyl group;

(2)

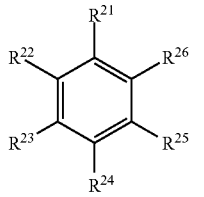

where at least two of $R^{21}$, $R^{23}$ and $R^{25}$ represents a structure represented by formula (3), each of the substituents except the substituents represented by formula (3) in $R^{21}$ to $R^{26}$ is a hydrogen atom or a methyl group;

(3)

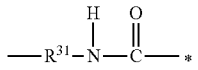

where $R^{31}$ is a single bond or an optionally substituted methylene group, $R^{31}$ bonds to the ring in the cyclic structure represented by formulae (1) or (2), and * indicates a bonding site, wherein the resin contains a cured product obtained by polymerizing a composition containing a monomer having a polymerizable functional group and the triarylamine structure, and a monomer having a polymerizable functional group and the cyclic structure, the polymerizable functional group being at least one of an acryloyloxy group and a methacryloyloxy group, a content of a structure represented by one of formulae (1') and (2') in the protective layer determined by pyrolysis gas chromatography-mass spectrometry is 10 to 20 mass% with respect to a total weight of the protective layer (1')

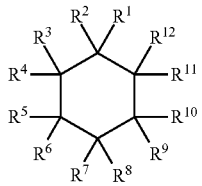

where at least two of $R^1$, $R^5$ and $R^9$ represents a structure represented by formula (3'), and each of the substituents except the substituents represented by formula (3') in $R^1$ to $R^{12}$ is a hydrogen atom or a methyl group;

(2')

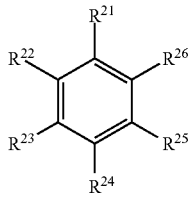

where at least two of $R^{21}$, $R^{23}$ and $R^{25}$ represents a structure represented by formula (3'), and each of the substituents except the substituents represented by formula (3') in $R^{21}$ to $R^{26}$ is a hydrogen atom or a methyl group $$—R^{31}—NCO \quad (3')$$

where $R^{31}$ represents a single bond or an optionally substituted methylene group, and A is 0.020 to 0.075 when A=S1/S2, and S1 and S2 each represent a peak area of a spectrum obtained by subjecting a surface of the protective layer to measurement by a Fourier transform infrared spectroscopy total reflection method using Ge as an internal reflection element and a measurement condition of 45° as an incident angle, when S1 is a peak area based on in-plane deformation vibration of a terminal olefin ($CH_2$=), and S2 is a peak area based on stretching vibration of C=O.

2. An image-forming apparatus according to claim 1, wherein the resin further has a structure represented by formula (5)

(5)

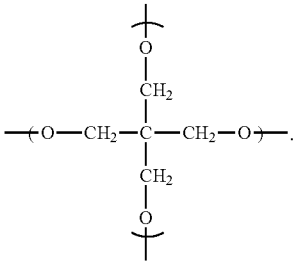

3. An image-forming apparatus according to claim 1, wherein the protective layer comprises a triphenylamine structure, one of an acryloyloxy group and a methacryloyloxy group, and a structure represented by formula (1).

4. An image-forming apparatus according to claim 1, wherein the protective layer has a contact angle with respect to pure water of 85 to 95°.

5. An image-forming apparatus according to claim 1, wherein the protective layer has a universal hardness value HU of 230 to 260 N/mm$^2$.

6. An image-forming apparatus according to claim 1, wherein the fatty acid metal salt contains zinc stearate.

7. An image-forming apparatus according to claim 1, wherein the protective layer comprises one of a siloxane structure and a fluoro group.

8. A process cartridge comprising:

an electrophotographic photosensitive member including a support, a photosensitive layer, and a protective layer in this order;

a charging unit configured to charge the electrophotographic photosensitive member;

a developing unit configured to develop the electrostatic latent image with a toner to form a toner image; and a cleaning unit configured to clean with a cleaning blade toner that remains on the electrophotographic photosensitive member after transferring the toner image from the electrophotographic photosensitive member, and a fatty acid metal salt supplying unit for supplying a fatty acid metal salt having 16 to 18 carbon atoms, to a surface of the electrophotographic photosensitive member, the fatty acid metal salt supplying unit storing the fatty acid metal salt, wherein the protective layer comprises a resin having a triphenylamine structure, and a structure represented by one of formulae (1) and (2):

(1)

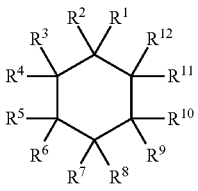

where at least two of $R^1$, $R^5$ and $R^9$ represents a structure represented by formula (3), and each of the substituents except the substituents represented by formula (3) in $R^1$ to $R^{12}$ is a hydrogen atom or a methyl group;

(2)

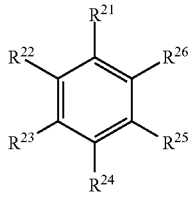

where at least two of $R^{21}$, $R^{23}$ and $R^{25}$ represents a structure represented by formula (3), and each of the substituents except the substituents represented by formula (3) in $R^{21}$ to $R^{26}$ is a hydrogen atom or a methyl group;

(3)

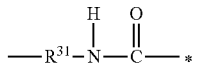

in the general formula (3), $R^{31}$ represents a single bond or a methylene group that may have a substituent, $R^{31}$ bonds to the ring in the cyclic structure represented by General Formula (1) or (2), and * indicates a bonding site, wherein the resin contains a cured product obtained by polymerizing a composition containing a monomer having a polymerizable functional group and the triarylamine structure, and a monomer having a polymerizable functional group and the cyclic structure, the polymerizable functional group being at least one of an acryloyloxy group and a methacryloyloxy group, where a content of a structure represented by one of formulae (1') and (2') in the protective layer determined by pyrolysis gas chromatography-mass spectrometry is 10 to 20 mass% with respect to a total weight of the protective layer (1')

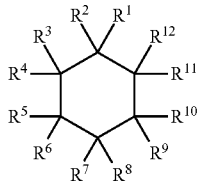

where at least two of $R^1$, $R^5$ and $R^9$ represents a structure represented by formula (3'), and each of the substituents except the substituents represented by formula (3') in $R^1$ to $R^{12}$ is a hydrogen atom or a methyl group;

(2')

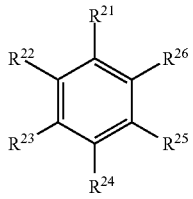

where at least two of $R^{21}$, $R^{23}$ and $R^{25}$ represents a structure represented by formula (3'), and each of the substituents except the substituents represented by formula (3') in $R^{21}$ to $R^{26}$ is a hydrogen atom or a methyl group;

$$—R^{31}—NCO \quad (3')$$

where $R^{31}$ represents a single bond or an optionally substituted methylene group, and A is 0.020 to 0.075 when A=S1/S2, and S1 and S2 each represent a peak area of a spectrum obtained by subjecting a surface of the protective layer to measurement by a Fourier transform infrared spectroscopy total reflection method using Ge as an internal reflection element and a measurement condition of 45° as an incident angle, when S1 is a peak area based on in-plane deformation vibration of a terminal olefin ($CH_2$=), and S2 is a peak area based on stretching vibration of C=O.

9. A process cartridge according to claim 8, wherein the resin further has a structure represented by formula (5)

(5)

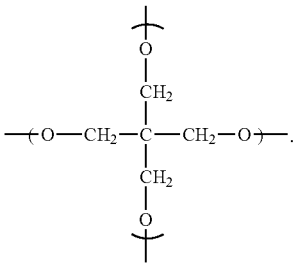

10. A process cartridge according to claim 8, wherein the protective layer comprises a triphenylamine structure, one of an acryloyloxy group and a methacryloyloxy group, and a structure represented by formula (1).

11. A process cartridge according to claim 8, wherein the protective layer has a contact angle with respect to pure water of 85 to 95°.

12. A process cartridge according to claim 8, wherein the protective layer has a universal hardness value HU of 230 to 260 N/mm$^2$.

13. A process cartridge according to claim 8, wherein the fatty acid metal salt contains zinc stearate.

14. A process cartridge according to claim 8, wherein the protective layer comprises one of a siloxane structure and a fluoro group.

15. An image-forming apparatus comprising:

an electrophotographic photosensitive member including a support, a photosensitive layer, and a protective layer in this order;

a charging unit configured to charge the electrophotographic photosensitive member;

an exposing unit configured to expose the electrophotographic photosensitive member to light to form an electrostatic latent image;

a developing unit configured to develop the electrostatic latent image with a toner to form a toner image by supplying the toner to a surface of the protective layer, wherein the developing unit stores the toner, and the toner contains toner particles having a fatty acid metal salt having 16 to 18 carbon atoms;

a transferring unit configured to transfer the toner image from the electrophotographic photosensitive member onto a transfer material; and a cleaning unit configured to clean with a cleaning blade toner that remains on the electrophotographic photosensitive member after transferring the toner image from the electrophotographic photosensitive member by the transferring unit, the protective layer comprises a resin having a triphenylamine structure, and a structure represented by one of formulae (1) and (2):

(1)

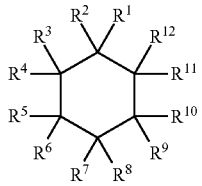

where at least two of $R^1$, $R^5$ and $R^9$ represents a structure represented by formula (3), and each of the substituents except the substituents represented by formula (3) in $R^1$ to $R^{12}$ is a hydrogen atom or a methyl group;

(2)

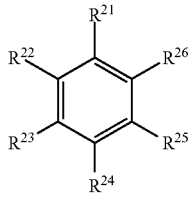

where at least two of $R^{21}$, $R^{23}$ and $R^{25}$ represents a structure represented by formula (3), each of the substituents except the substituents represented by formula (3) in $R^{21}$ to $R^{26}$ is a hydrogen atom or a methyl group;

(3)

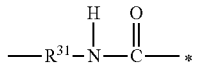

where $R^{31}$ is a single bond or an optionally substituted methylene group, $R^{31}$ bonds to the ring in the cyclic structure represented by formulae (1) or (2), and * indicates a bonding site, wherein the resin contains a cured product obtained by polymerizing a composition containing a monomer having a polymerizable functional group and the wtriarylamine structure, and a monomer having a polymerizable functional group and the cyclic structure, the polymerizable functional group being at least one of an acryloyloxy group and a methacryloyloxy group, a content of a structure represented by one of formulae (1') and (2') in the protective layer determined by pyrolysis gas chromatography-mass spectrometry is 10 to 20 mass % with respect to a total weight of the protective layer (1')

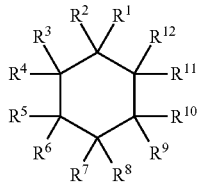

where at least two of $R^1$, $R^5$ and $R^9$ represents a structure represented by formula (3'), and each of the substituents except the substituents represented by formula (3') in $R^1$ to $R^{12}$ is a hydrogen atom or a methyl group;

(2')

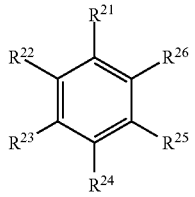

where at least two of $R^{21}$, $R^{23}$ and $R^{25}$ represents a structure represented by formula (3'), and each of the substituents except the substituents represented by formula (3') in $R^{21}$ to $R^{26}$ is a hydrogen atom or a methyl group $$—R^{31}—NCO \quad (3')$$

where $R^{31}$ represents a single bond or an optionally substituted methylene group , and A is 0.020 to 0.075 when A=S1/S2, and S1 and S2 each represent a peak area of a spectrum obtained by subjecting a surface of the protective layer to measurement by a Fourier transform infrared spectroscopy total reflection method using Ge as an internal reflection element and a measurement condition of 45° as an incident angle, when S1 is a peak area based on in-plane deformation vibration of a terminal olefin ($CH_2$═), and S2 is a peak area based on stretching vibration of CO═O.

16. A process cartridge comprising:

an electrophotographic photosensitive member including a support, a photosensitive layer, and a protective layer in this order;

a charging unit configured to charge the electrophotographic photosensitive member;

a developing unit configured to develop the electrostatic latent image with a toner to form a toner image by supplying the toner to a surface of the protective layer, wherein the developing unit stores the toner, and the toner contains a fatty acid metal salt having 16 to 18 carbon atoms, wherein the developing unit stores the toner, and the toner contains toner particles having a fatty acid metal salt having 16 to 18 carbon atoms; and a cleaning unit configured to clean with a cleaning blade toner that remains on the electrophotographic photosensitive member after transferring the toner image from the electrophotographic photosensitive member, wherein the protective layer comprises a resin having a triphenylamine structure, and a structure represented by one of formulae (1) and (2):

(1)

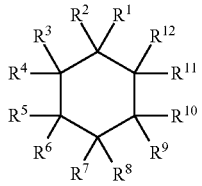

where at least two of $R^1$, $R^5$ and $R^9$ represents a structure represented by formula (3), and each of the substituents except the substituents represented by formula (3) in $R^1$ to $R^{12}$ is a hydrogen atom or a methyl group;

(2)

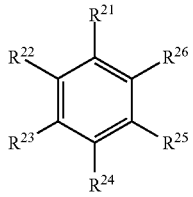

where at least two of $R^{21}$, $R^{23}$ and $R^{25}$ represents a structure represented by formula (3), and each of the substituents except the substituents represented by formula (3) in $R^{21}$ to $R^{26}$ is a hydrogen atom or a methyl group;

(3)

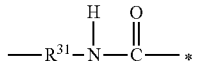

in the general formula (3), $R^{31}$ represents a single bond or a methylene group that may have a substituent, $R^{31}$ bonds to the ring in the cyclic structure represented by General Formula (1) or (2), and * indicates a bonding site, wherein the resin contains a cured product obtained by polymerizing a composition containing a monomer having a polymerizable functional group and the triarylamine structure, and a monomer having a polymerizable functional group and the cyclic structure, the polymerizable functional group being at least one of an acryloyloxy group and a methacryloyloxy group, a content of a structure represented by one of formulae (1') and (2') in the protective layer determined by pyrolysis gas chromatography-mass spectrometry is 10 to 20 mass % with respect to a total weight of the protective layer (1')

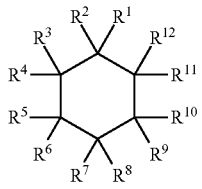

where at least two of $R^1$, $R^5$ and $R^9$ represents a structure represented by formula (3'), and each of the substituents except the substituents represented by formula (3') in $R^1$ to $R^{12}$ is a hydrogen atom or a methyl group;

(2')

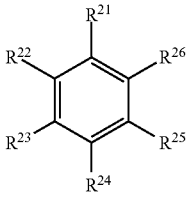

where at least two of $R^{21}$, $R^{23}$ and $R^{25}$ represents a structure represented by formula (3'), and each of the substituents except the substituents represented by formula (3') in $R^{21}$ to $R^{26}$ is a hydrogen atom or a methyl group;

$$—R^{31}—NCO \quad (3')$$

where $R^{31}$ represents a single bond or an optionally substituted methylene group, and A is 0.020 to 0.075 when A=S1/S2, and S1 and S2 each represent a peak area of a spectrum obtained by subjecting a surface of the protective layer to measurement by a Fourier transform infrared spectroscopy total reflection method using Ge as an internal reflection element and a measurement condition of 45° as an incident angle, when S1 is a peak area based on in-plane deformation vibration of a terminal olefin ($CH_2$═), and S2 is a peak area based on stretching vibration of CO═O.

* * * * *